US007928373B2

(12) United States Patent
Quarmby et al.

(10) Patent No.: US 7,928,373 B2
(45) **Date of Patent: *Apr. 19, 2011**

(54) ISOLATING IONS IN QUADRUPOLE ION TRAPS FOR MASS SPECTROMETRY

(75) Inventors: Scott T. Quarmby, Round Rock, TX (US); Jae C. Schwartz, San Jose, CA (US); John E. P. Syka, Charlottesville, VA (US)

(73) Assignee: Thermo Finnigan LLC, San Jose, CA (US)

( * ) Notice: Subject to any disclaimer, the term of this patent is extended or adjusted under 35 U.S.C. 154(b) by 110 days.

This patent is subject to a terminal disclaimer.

(21) Appl. No.: 11/713,210

(22) Filed: Mar. 2, 2007

(65) Prior Publication Data

US 2007/0164208 A1 Jul. 19, 2007

Related U.S. Application Data

(63) Continuation of application No. 10/922,809, filed on Aug. 19, 2004, now Pat. No. 7,456,396.

(51) Int. Cl.
*H01J 48/42* (2006.01)

(52) U.S. Cl. ..... 250/292; 250/282

(58) Field of Classification Search ..... 250/292
See application file for complete search history.

(56) References Cited

U.S. PATENT DOCUMENTS

| | | | | |
|---|---|---|---|---|
| 4,882,484 | A * | 11/1989 | Franzen et al. | 250/282 |
| 5,517,025 | A * | 5/1996 | Wells et al. | 250/282 |
| 5,696,376 | A * | 12/1997 | Doroshenko et al. | 250/292 |
| 6,093,929 | A | 7/2000 | Javahery et al. | |
| 6,753,523 | B1 * | 6/2004 | Whitehouse et al. | 250/292 |

FOREIGN PATENT DOCUMENTS

WO WO 03/041107 A2 5/2003

* cited by examiner

*Primary Examiner* — Robert Kim
*Assistant Examiner* — Phillip A. Johnston
(74) *Attorney, Agent, or Firm* — Fish & Richardson; Charles B. Katz

(57) ABSTRACT

Ions in a predefined narrow mass to charge ratio range are isolated in an ion trap by adjusting the field and using ejection frequency waveform(s). The ejection waveforms have frequency components in a first and a second dimension, and, are applied across electrodes aligned along a first and a second dimension. Thus the mass-to-charge ratio isolation window is controlled and has an improved resolution without increasing the number of frequency components.

24 Claims, 16 Drawing Sheets

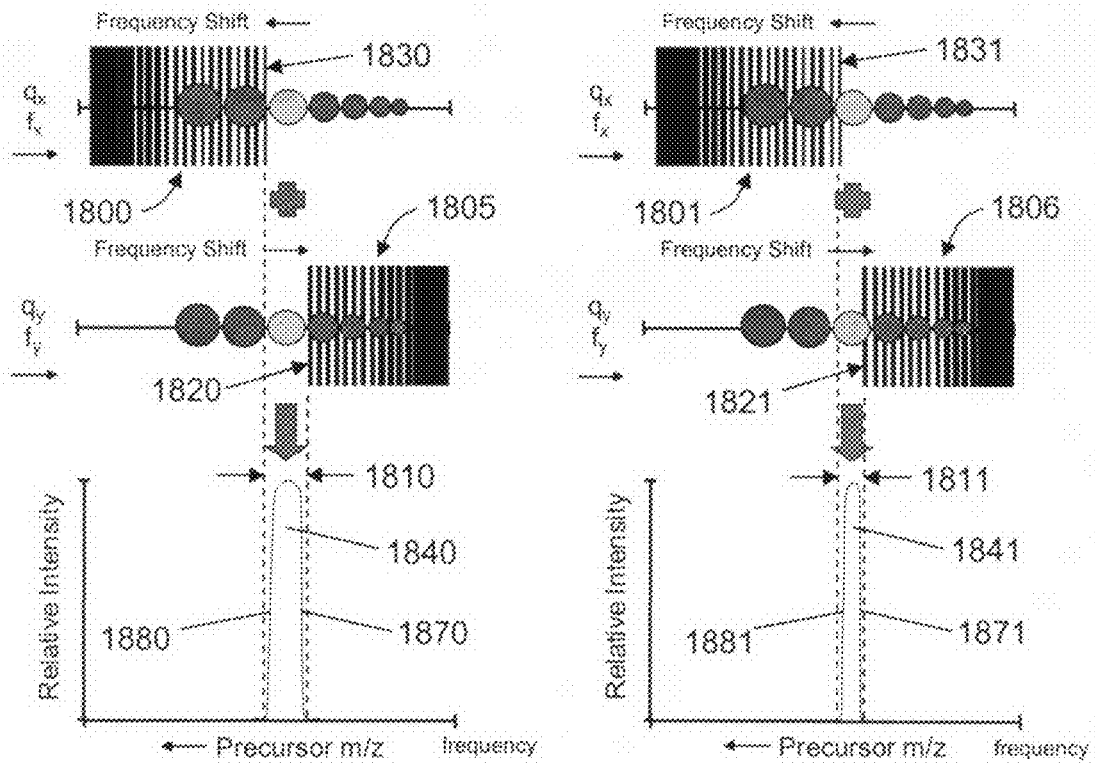
(a) FIG. 18 (b)
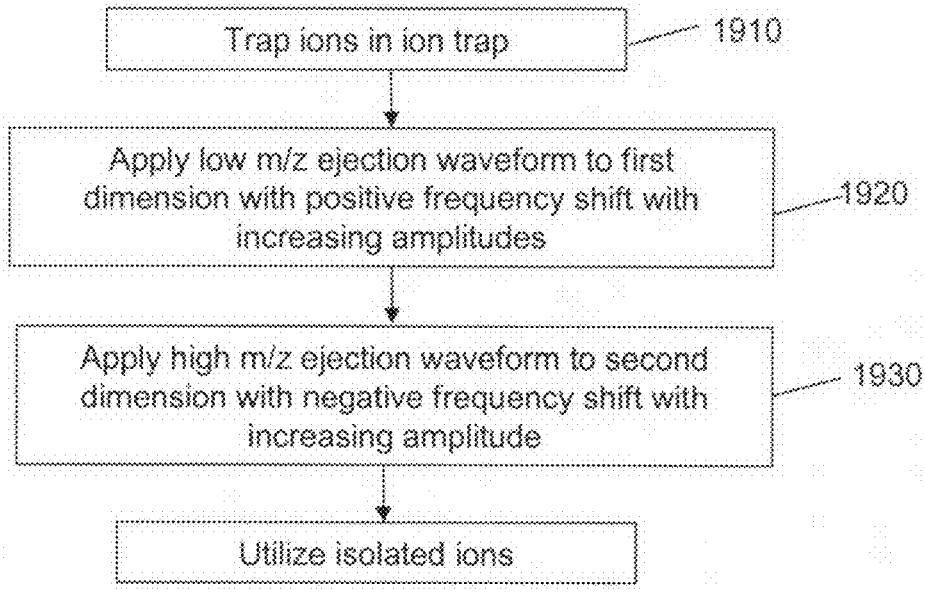
FIG. 19

ISOLATING IONS IN QUADRUPOLE ION TRAPS FOR MASS SPECTROMETRY

CROSS-REFERENCE TO RELATED APPLICATION

This application is a continuation of and claims priority from U.S. patent application Ser. No. 10/922,809 entitled "Isolating Ions In Quadrupole Ion Traps for Mass Spectrometry" filed on Aug. 19, 2004 now U.S. Pat. No. 7,456,396.

BACKGROUND

The present application relates to isolating ions in a quadrupole ion trap.

Quadrupole ion traps are used in mass spectrometers to store ions that have mass-to-charge ratios (m/z—where m is the mass and z is the number of elemental charges) within some predefined range. In the ion trap, the stored ions can be manipulated. For example, ions having particular mass-to-charge ratios can be isolated or fragmented. The ions can also be selectively ejected or otherwise eliminated from the ion trap based on their mass-to-charge ratios to a detector to create a mass spectrum. The stored ions can also be extracted, transferred or ejected into an associated tandem mass analyzer such as a Fourier Transform, RF Quadrupole Analyzer, Time of Flight Analyzer or a second Quadrupole Ion Trap Analyzer.

All ion traps have limitations in how many ions can be stored or manipulated efficiently. In addition, obtaining structural information of a particular ion can also require that ions having a particular m/z (or m/z's) be selectively isolated in the ion trap and all other ions be eliminated from the ion trap. In an MS/MS experiment, the isolated ions are subsequently fragmented into product ions that are analyzed to obtain the structural information of the particular ion. Thus, there are several reasons for efficient ion isolation techniques in ion trapping instruments.

Quadrupole ion traps use substantially quadrupole fields to trap the ions. In pure quadrupole fields, the motion of the ions is described mathematically by the solutions to a second order differential equation called the Mathieu equation. Solutions can be developed for a general case that applies to all radio frequency (RF) and direct current (DC) quadrupole devices including both two-dimensional and three-dimensional quadrupole ion traps. A two dimensional quadrupole trap is described in U.S. Pat. No. 5,420,425, and a three-dimensional quadrupole trap is described in U.S. Pat. No. 4,540,884, both of which are incorporated in their entirety by reference.

In general, solutions to the Mathieu equation and corresponding motion of the ions are characterized by reduced parameters $a_u$ and $q_u$ where u represents an x, y, or z spatial direction that corresponds to the displacement along the axis of symmetry of the field.

$$a_u=(K_a eU)/(mr_o^2\omega^2) \quad q_u=(K_q eV)/(mr_o^2\omega^2)$$

where:

V=Amplitude of the applied radio frequency (RF) sinusoidal voltage

U=Amplitude of the applied direct current (DC) voltage e charge on the ion m=mass of the ion $r_o$=device characteristic dimension $\omega=2\pi f$ f=frequency of RF voltage $K_a$=device-field geometry dependent constant for $a_u$ $K_q$=device-field geometry dependent constant for $q_u$ The RF voltage generates an RF quadrupole field that works to confine the ions' motion to within the device. This motion is characterized by characteristic frequencies (also called primary frequencies) and additional, higher order frequencies and these characteristic frequencies depend on the mass and charge of the ion. A separate characteristic frequency is also associated with each dimension in which the quadrupole field acts. Thus separate axial (z dimension) and radial (x and y dimensions) characteristic frequencies are specified for a 3-dimensional quadrupole ion trap. In a 2-dimensional quadrupole ion trap, the ions have separate characteristic frequencies in x and y dimensions. For a particular ion, the particular characteristic frequencies depend not only on the mass of the ion, the charge on the ion, but also on several parameters of the trapping field.

An ion's motion can be excited by resonating the ion at one or more of their characteristic frequencies using a supplementary AC field. The supplementary AC field is superposed on the main quadrupole field by applying a relatively small oscillating (AC) potential to the appropriate electrodes. To excite ions having a particular m/z, the supplementary AC field includes a component that oscillates at or near the characteristic frequency of the ions' motion. If ions having more than one m/z are to be excited, the supplementary field can contain multiple frequency components that oscillate with respective characteristic frequencies of each m/z to be resonated.

To generate the supplementary AC field, a supplementary waveform is generated by a waveform generator, and the voltage associated with the generated waveform is applied to the appropriate electrodes by a transformer. The supplementary waveform can contain any number of frequency components that are added together with some relative phase. These waveforms are hereon referred to as a resonance ejection frequency waveform or simply an ejection frequency waveform. These ejection frequency waveforms can be used to resonantly eject a range of unwanted ions from the ion trap.

When an ion is driven by a supplementary field that includes a component whose oscillation frequency is close to the ion's characteristic frequency, the ion gains kinetic energy from the field. If sufficient kinetic energy is coupled to the ion, its oscillation amplitude can exceed the confines of the ion trap. The ion will subsequently impinge on the wall of the trap or will be ejected from the ion trap if an appropriate aperture exists.

Because different m/z ions have different characteristic frequencies, the oscillation amplitude of the different m/z ions can be selectively determined by exciting the ion trap. This selective manipulation of the oscillation amplitude can be used to remove unwanted ions at any time from the trap. For example, an ejection frequency waveform can be utilized to isolate a narrow range of m/z ratios during ion accumulation when the trap is first filled with ions. In this way the trap may be filled with only the ions of interest, thus allowing a desired m/z ratio to be detected with enhanced signal-to-noise ratio. Also a specific m/z range can be isolated within the ion trap either after filling the trap for performing an MS/MS experiment or after each dissociation stage in $MS^n$ experiments.

Ion isolation can be performed using broadband resonance ejection frequency waveforms that are typically created by summing discrete frequency components represented by sine waves (as described in U.S. Pat. No. 5,324,939). That is, the summed sine waves have discrete frequencies corresponding to the m/z range of ions that one desires to eject but excluding frequency components corresponding to the m/z range of ions that one desires to retain. The omitted frequencies define a frequency notch in the ejection frequency waveform. Thus when the ejection frequency waveform is applied, ions having undesired m/z's can be essentially simultaneously ejected or otherwise eliminated while the desired m/z ions are retained, because their m/z ratio values correspond to where the frequency components are missing from the ejection waveform.

To eject or otherwise eliminate all undesired ions substantially simultaneously, the ejection frequency waveform needs to include closely spaced discrete frequency components. Thus the ejection frequency waveform is typically generated from a large number of sine waves. In general, controlling such waveform generation is a complex problem. The general problem can be simplified if the discrete frequencies of the sine waves are spaced uniformly, and each sine wave has the same relative amplitude.

To further simplify the waveform generation, the discrete frequencies may be relatively widely separated (spaced, for example, at least 1500 Hz apart), and the system can include a means to modulate the RF voltage to cause ions that would otherwise fall between frequency components to come into resonance (see, e.g. U.S. Pat. No. 5,457,315).

When it is desirable to isolate a m/z range whose width is substantially less that 1 amu (atomic mass unit, which is $1.660538\times10^{-27}$ kilograms), the broadband ejection frequency waveforms may require many frequency components that are spaced so closely that waveform generation becomes impractical. Such a waveform if utilized would, in addition, have to be applied for an impractically long time. For example with an RF frequency of 760 kHz, obtaining even unit resolution isolation is difficult above m/z 1200 using 500 Hz spacing. In an alternative technique, the supplementary field includes only a single frequency component, and the undesired ions are ejected by slowly increasing or decreasing the amplitude of the trapping RF voltage (see Schwartz, J. C.; Jardine, I. *Rapid Comm. Mass Spectrum.* 6 1992 313).

SUMMARY

Ions in a predefined narrow m/z range are isolated in an ion trap by adjusting the field and using ejection waveform(s). Thus the mass-to-charge ratio isolation window is controlled and has an improved resolution without increasing the number of frequency components.

In general, the invention provides methods and apparatus for isolating ions in an ion trap. The ion traps are configured to utilize the generation of a field having a first value to contribute to the retention of ions in the ion trap. The ions to be isolated have a range of mass to charge ratios defined by a low mass to charge ratio limit and a high mass to charge ratio limit, and an initial corresponding range of characteristic frequencies. The ion trap has a plurality of electrodes.

In one aspect of the invention, the invention is directed to a method that includes applying an ejection frequency waveform to at least one electrode, the ejection frequency waveform having at least a first frequency edge and a second frequency edge, and at least the initial corresponding frequencies of the range of ions to be isolated being included in the range of frequencies between the first and second frequency edges, such that initially, all ions with an initial corresponding range of characteristic frequencies between the first and second frequency edges are retained in the ion trap. The field is adjusted from a second to a third value, the second and third values being selected such that substantially all ions outside the range of mass to charge ratios to be isolated are eliminated from the ion trap.

In another aspect of the invention, the characteristic frequencies comprise frequency components of a first dimension and frequency components of a second dimension. The ion trap includes electrodes comprising electrodes aligned along the first dimension and electrodes aligned along the second dimension, and the method comprises, applying a first portion of an ejection frequency waveform across the electrodes aligned to the first dimension, the first portion of the ejection waveform comprising at least a first frequency edge and a second frequency edge in the first dimension, and at least the initial corresponding range of characteristic frequencies in the first dimension of the range of mass to charge ratios to be isolated are included in the range of frequencies between the first edge and the second edge; applying a second portion of the ejection frequency waveform across the electrodes aligned to the second dimension, the second portion of the ejection frequency waveform having a third frequency edge and a fourth frequency edge in the second dimension, and at least the initial corresponding frequencies in the second dimension of the range of ions to be isolated are included in the range of frequencies between the third edge and the fourth edge.

In another aspect, the invention is directed to a method comprises applying a first ejection frequency waveform comprising at least two frequencies to at least one electrode, the first ejection frequency waveform having at least a first edge, and adjusting the field from a second to a third value, the values selected such that at least all ions initially having characteristic frequencies between the first edge and the nearest limit of the mass to charge range are eliminated from the ion trap.

In another aspect, the characteristic frequency components comprise frequency components of a first dimension and frequency components of a second dimension. The ion trap includes a plurality of electrodes comprising electrodes aligned along the first dimension and electrodes aligned along the second dimension. The method comprises applying a first ejection frequency waveform comprising at least two frequencies to at least one electrode aligned to the first dimension, the first ejection frequency waveform having at least a first edge, and adjusting the field from a second to a third value, the values selected such that all ions having characteristic frequencies between the first edge and the nearest limit of the mass to charge range are eliminated from the ion trap.

In another aspect, the characteristic frequencies comprise frequency components of a first dimension and frequency components of a second dimension. The ion trap includes electrodes comprising electrodes aligned along the first dimension and electrodes aligned along the second dimension. The method comprises applying a first portion of an ejection frequency waveform across the electrodes aligned to the first dimension, the first portion of the ejection waveform comprising at least two frequencies, the first ejection frequency waveform having at least a first frequency edge; applying a second portion of the ejection frequency waveform across the electrodes aligned to the second dimension, the second portion of the ejection frequency waveform comprising at least two frequencies, the second ejection frequency waveform having at least a second frequency edge.

Particular implementations can include one or more of the following features. The field may be a quadrupolar field. The field may be adjusted by adjusting the RF voltage. The field may be adjusted by adjusting the DC voltage. The second value of the field may be selected such that ions above the high mass to charge ratio limit are ejected from the ion trap. The third value of the field may be selected such that ions below the low mass to charge ratio limit are ejected from the ion trap. The field may be adjusted from a second to a third value in one stepped transition. The stepped transition may be carried out in less than about 1 ms. The field may be adjusted from a second to a third value in at least one gradual transition. The time for the at least one gradual transition may have some dependency on the mass to charge ratio to be isolated or on the isolation resolution required. Prior to applying the second value of the field, a prior value may be applied such that the range of mass to charge ratios to be isolated are placed such that their initial corresponding range of characteristic frequencies are between the first and second frequency edges. The ejection frequency waveform may be generated using a sequence of ordered frequencies that are selected from discrete frequencies. The discrete frequencies may be substantially uniformly spaced. The discrete frequencies may be spaced about 750 Hz or less from each other. The discrete frequencies may be spaced about 500 Hz or less from each other. The electrodes may comprise electrodes aligned to first dimension and electrodes aligned to a second dimension. The ejection waveform may be applied to the electrode aligned to the first dimension and the electrode aligned to the second dimension simultaneously. The ejection waveform may be applied to the electrode aligned to the first dimension and the electrode aligned to the second dimension sequentially. The waveform may comprise at least two waveform portions. The waveform portions may be applied substantially simultaneously. The waveform portion may be applied sequentially. The waveform portion may be applied one after the other, sequentially, multiple times. The first of the two waveform portions may define the first edge of the ejection frequency waveform. The second of the two waveform portions may define the second edge of the ejection frequency waveform. The ejection frequency waveform may comprise frequency components in at least two dimensions. The frequency component in the first dimension may be applied to the electrode aligned to the first dimension sequentially to the frequency component in the second dimension being applied to the electrode aligned to the second dimension. The frequency component in the first dimension may be applied to the electrode aligned to the first dimension simultaneously to the frequency component in the second dimension being applied to the electrode aligned to the second dimension. The ion trap may be a RF quadrupolar ion trap. The RF quadrupolar ion trap may be a 2-D ion trap. The RF quadrupolar ion trap may be a 3-D ion trap.

In another aspect, the invention is directed to a computer program product tangibly embodied in a computer readable medium with instructions to control an ion trap according to the methods above.

The invention can be implemented to realize one or more of the following advantages. High resolution isolation is defined as isolating m/z ranges narrower than 1 Th (Thompson=amu/number of elemental charges). For example, this might mean isolating a m/z range of 0.5 Th, 0.3 Th, 0.1, or ranges <0.1 Th. In some cases though, isolating a m/z range of even 1 Th or more is not possible under a particular set of operating conditions. In these cases, high resolution isolation means isolating a narrower m/z range than can be done with other isolation techniques. High resolution isolation can be accomplished while maintaining the ability to eject any fragment ions which are formed during isolation, thus solving a problem in the existing methods of high resolution isolation. The high resolution isolation can be achieved using uniform discrete frequencies without introducing special frequency terms (i.e. frequency terms which do not fall on the regular and/or uniform spacing of the discrete frequencies) near the edges of the frequency notch. A substantially quadrupolar ion trap can be constructed such that ion frequencies shift up with increasing oscillation amplitude in one dimension of the ion trap (e.g. in x), and shift down with increasing oscillation amplitude in the other dimension (e.g. in y). By exciting ions with frequencies above the ejection frequency waveform notch in the x direction and below in the y direction, a sharp, symmetric resultant isolation profile window can be obtained which will also improve the isolation resolution of the complete isolation experiment.

These and further features and advantages of the present invention will become apparent from the following detailed description, wherein reference is made to the figures in the accompanying drawings.

Unless otherwise defined, all technical and scientific terms used herein have the meaning commonly understood by one of ordinary skill in the art to which this invention belongs. In case of conflict, the present specification, including definitions, will control. Unless otherwise noted, the terms "include", "includes" and "including" are used in an open-ended sense—that is, to indicate that the "included" subject matter is a part or component of a larger aggregate or group, without excluding the presence of other parts or components of the aggregate or group. The disclosed materials, methods, and examples are illustrative only and not intended to be limiting. Skilled artisans will appreciate that methods and materials similar or equivalent to those described herein can be used to practice the invention.

BRIEF DESCRIPTION OF THE DRAWINGS

FIG. 18 is a schematic diagram and FIG. 19 is a schematic flow chart illustrating a method for operating a quadrupole ion trap according to an aspect of the invention.

DETAILED DESCRIPTION

Figure 1:
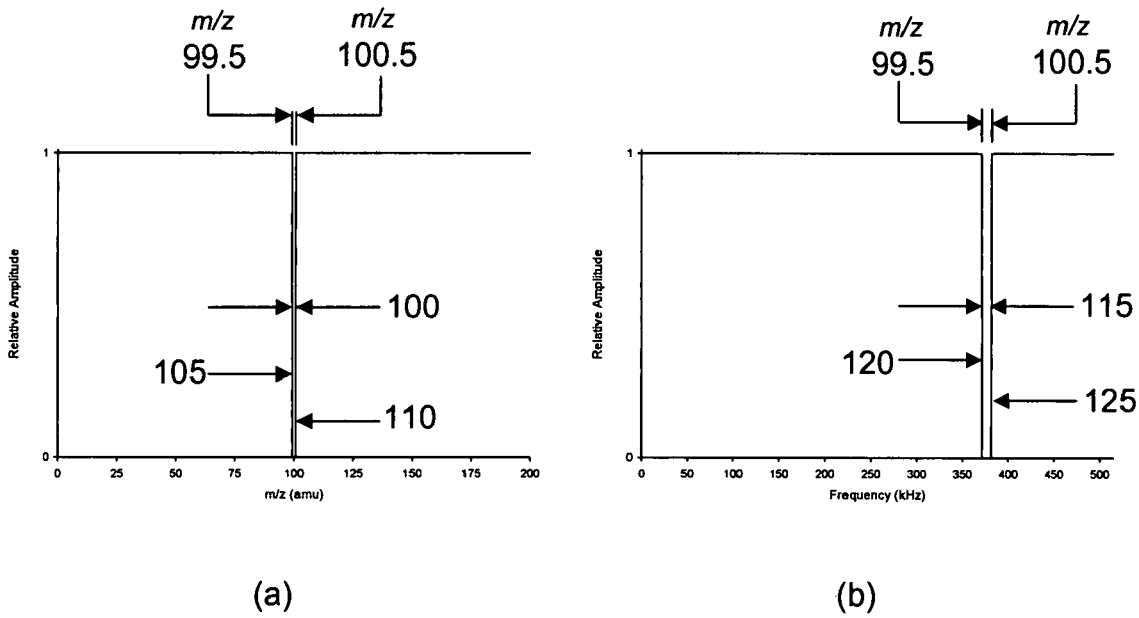
FIG. 1 is a schematic diagram illustrating an exemplary isolation window and a corresponding ejection frequency waveform notch.

FIG. 1 illustrates an exemplary isolation window 100 in a range of mass to charge ratios (m/z) (diagram a), the range of ratios defined by a high mass to charge ratio 110 limit and a low mass to charge ratio limit 105. Also illustrated is a corresponding ejection frequency waveform notch 115 in a frequency spectrum (diagram b), the ejection frequency waveform notch defined by a first and a second edge 120, 125 respectively. A waveform facilitates at least a portion of the ions outside the mass range to be isolated to be ejected from the ion trap. The isolation window 100 is a range of m/z ratios, in the example, from m/z 99.5 Th to 100.5 Th, for ions to be retained in a 3D quadrupole ion trap. The frequency notch 115 is defined based on the isolation window 100, and specifies a frequency gap that is a range of missing frequencies in the ejection waveform's frequency spectrum. In the example, the frequency notch 115 is calculated based upon a nominal isolation q=0.83 (axial dimension) and RF frequency of $\omega=2\pi 1022.64$ kHz. The RF amplitude applied to the ion trap is set so that ions to be retained in the desired m/z window 100 have characteristic frequencies which correspond approximately to the missing frequency components. Undesired ions have m/z values outside the m/z isolation window 100, and characteristic frequencies outside the ideal ejection waveform frequency notch 115. Thus the undesired ions will absorb energy from the supplementary AC field that is generated based on an ejection frequency waveform having the frequency notch 115 and will be ejected from the ion trap. Alternatively, the undesired ions will absorb energy from the supplementary AC field and develop trajectories such that they are caused to be neutralized or otherwise eliminated, by for example, impacting rods the electrodes in the ion trap.

Figure 2:
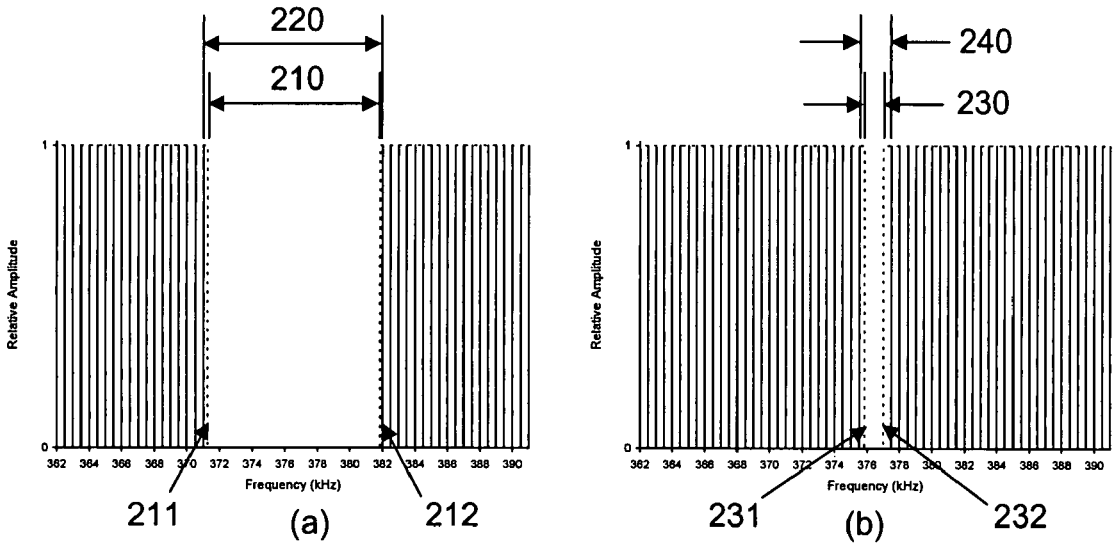
FIGS. 2 and 3 are schematic diagrams illustrating exemplary target notch edge frequencies for ejection waveforms and actual notch edge frequencies that result from rounding the target frequency notches to discrete frequency components in the broadband ejection frequency waveform.

FIG. 2 illustrates frequency notches in frequency spectrums that include discrete frequencies. The discrete frequencies are assigned to a finite number of sine waves that are used to construct the ejection frequency waveform. For example, a typical broadband frequency waveform is constructed from sinusoidal frequency components that have discrete frequencies between 10 kHz and 500 kHz spaced every 500 Hz (period of waveform is 2 ms). Thus a total of 981 discrete frequencies are used to generate the ejection frequency waveform in this example. If the frequency spacing is chosen correctly such that there are a sufficient number of frequency components to efficiently eject all of the undesired ions, then even those ions which have characteristic frequencies between the waveform frequency components will be ejected.

The spacing of the discrete frequencies limits the isolation resolution that is defined by the smallest m/z range that can be efficiently isolated. If the discrete frequencies are spaced in 500 Hz increments, the omitted frequencies define an actual ejection waveform frequency notch that is an integer multiple of 500 Hz. Thus the actual frequency notches yield quantized values for the isolation width. It is customary to round out the discrete frequencies so that the actual ejection frequency waveform notch is not narrower than the target isolation window.

FIG. 2 illustrates first and second exemplary ejection waveform frequency spectra (diagrams a and b) with target frequency notches 210 and 230 and corresponding rounded frequency notches 220 and 240, respectively. The first and second frequency spectrums specify substantially discrete frequency components, and can be used to generate ejection frequency waveforms by inverse discrete Fourier Transform computation or the like. In both spectrums, the discrete frequencies are spaced every 500 Hz, and for each discrete frequency, a relative amplitude is represented by the length of a corresponding solid vertical line. The relative phases of the discrete frequencies should be set in some manner such as is taught in U.S. Pat. No. 5,324,939.

The target frequency notches 210 and 230 correspond to a respective desired isolation window, similar to that of the isolation window 100. The target notch 210 is defined by edge frequencies 211 and 212, and the target notch 230 is defined by edge frequencies 231 and 232. When the discrete frequencies are used to generate the ejection frequency waveform, the edge frequencies 211, 212, 231 and 232 are rounded out to the nearest 500 Hz (rounded down for the lower frequency edge and up for the upper frequency edge). Thus the rounded frequency notches 220 and 240 are wider than the target frequency notches 210 and 230, respectively. In the example, the target frequency notches 210 and 230 correspond to isolation windows of m/z 69±0.5 Th and m/z 614±0.5 Th, respectively. This rounding insures that the minimum notch width corresponds to at least ±0.5 Th which is the desired notch width in this example. Thus each of the target notches 210 and 230 corresponds to isolation windows having the same width of 1.0 amu/unit charge (Th) at the same nominal isolation q, but for different nominal m/z values. Because higher m/z ions have characteristic frequencies that are spaced more closely together, the target frequency notch 210 (m/z centered at 69 Th) has a larger frequency width than that of the target frequency notch 230 (m/z centered at 614 Th). Due to the same effect, the rounding error is more pronounced for higher m/z ions.

Figure 3:
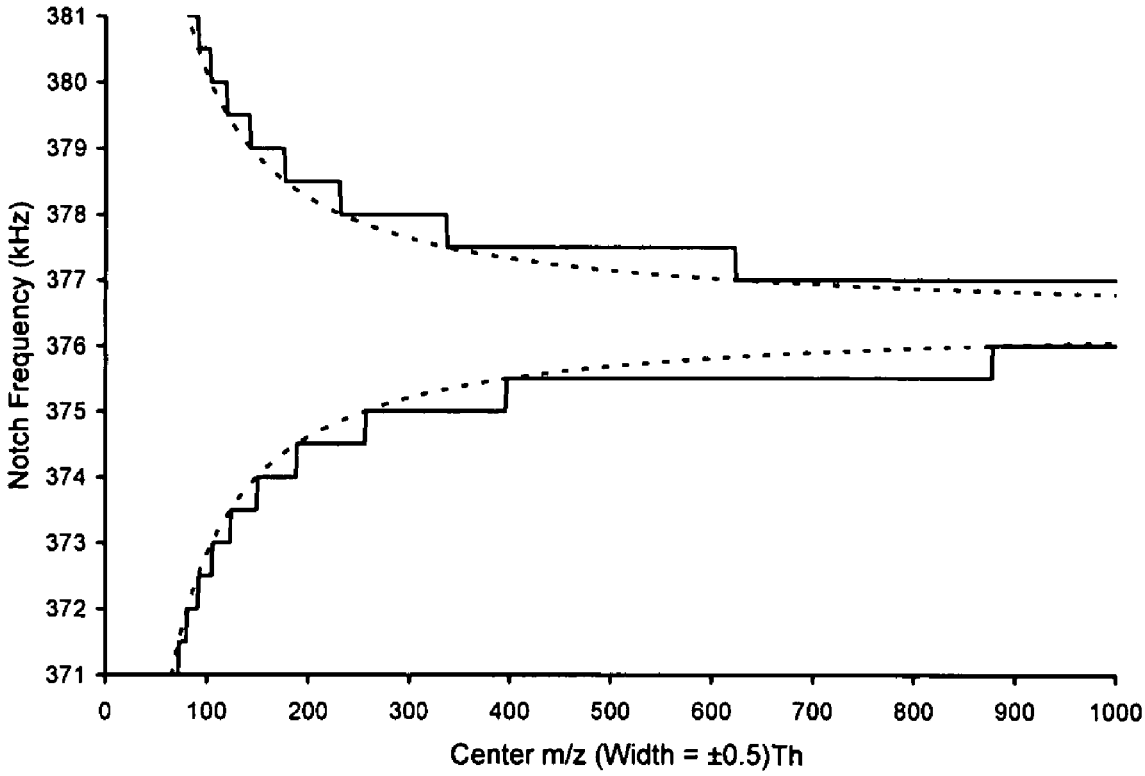

FIG. 3 compares target and rounded frequency notches as a function of a center m/z for a fixed isolation window width, such as 1 Th, of the isolation q of 0.83. Each frequency notch is represented by a corresponding pair of edge frequencies. The dotted lines represent the edge frequencies for the target frequency notch and the solid lines represent the associated quantized ejection waveform frequencies defining the corresponding frequency notch rounded to the nearest 500 Hz. The effect of rounding is clearly shown by the difference between the dotted lines and the respective solid lines.

Figure 4A:
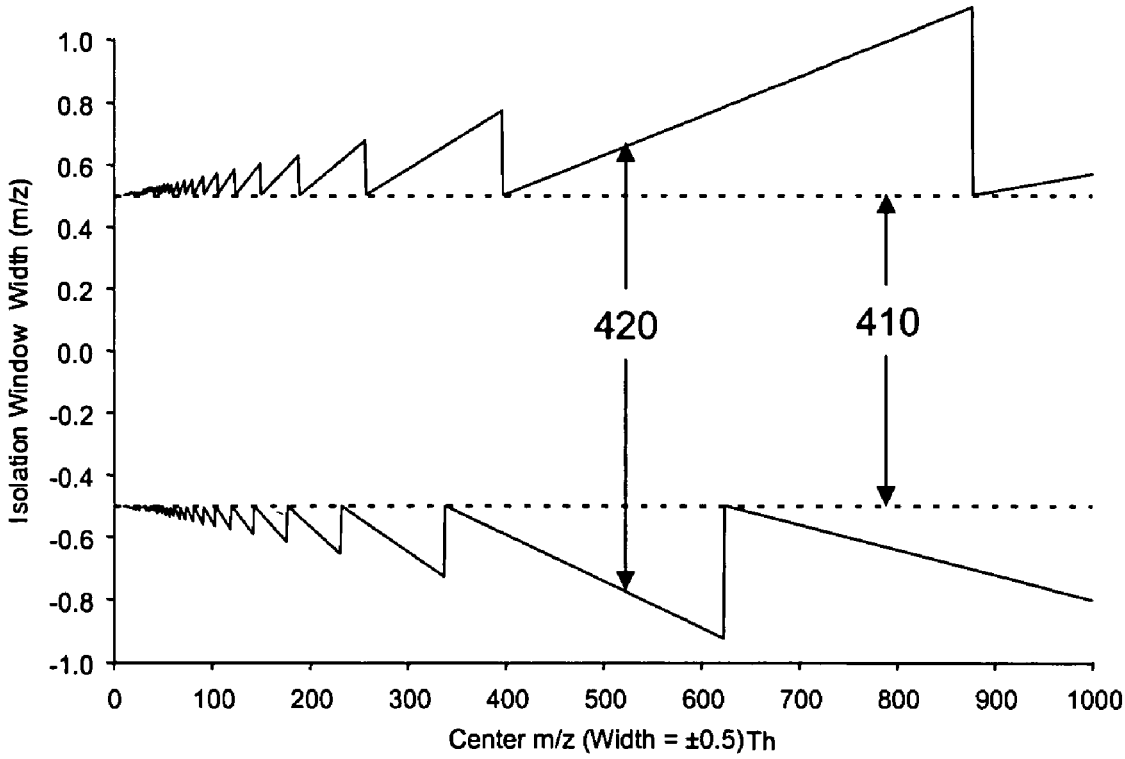
FIGS. 4*a* and 4*b* are schematic diagrams illustrating exemplary isolation windows that result from using discrete frequency components for ejection waveforms.
Figure 4B:
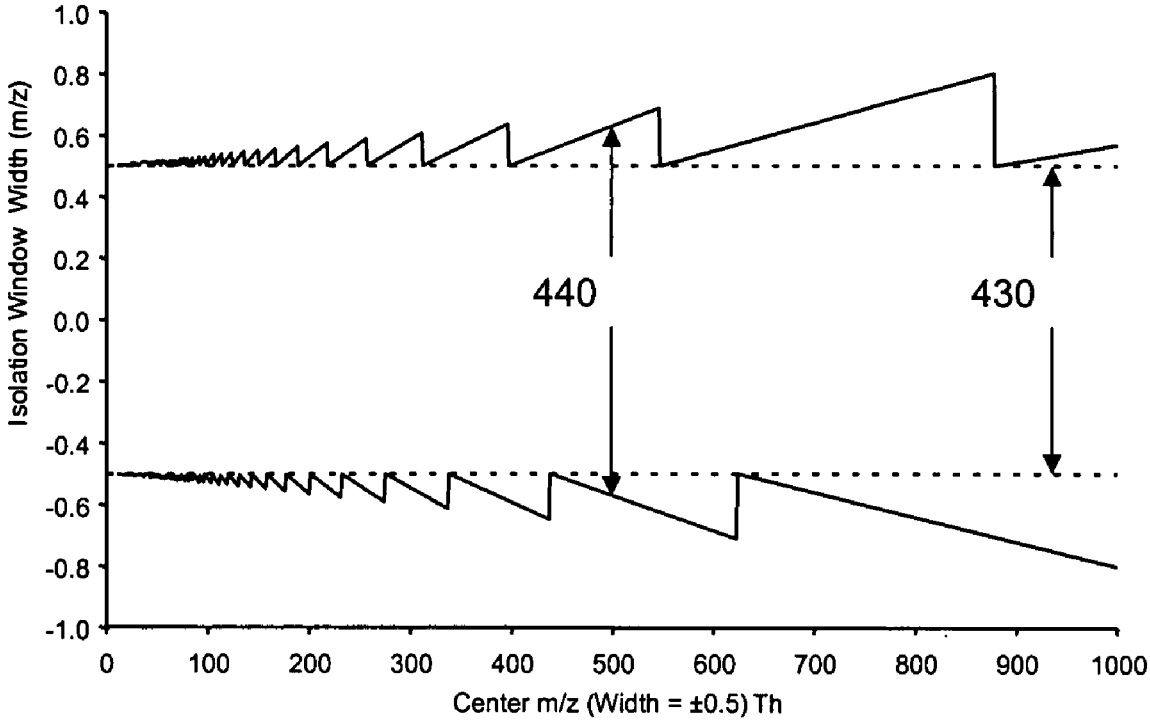

FIGS. 4*a* and 4*b* illustrate first and second diagrams showing rounded isolation widths (in m/z) 420 and 440, respectively, that are illustrated as a function of a center m/z of the isolation windows. The rounded isolation widths 420 and 440 correspond to target isolation widths 410 and 430, which have the same value of 1 Th in the example. The rounded isolation widths 420 and 440 result from using different spacings of the discrete frequency components to construct the ejection waveforms.

The rounded isolation width 420 corresponds to using discrete frequencies at each 500 Hz (FIG. 4*a*), and the rounded isolation width 440 corresponds to using discrete frequencies at each 250 Hz (FIG. 4*b*). As the frequency spacing interval is decreased from 500 Hz to 250 Hz, the accuracy increases for the rounded isolation width. However, the decreased frequency spacing requires twice as many sine components for calculating the ejection waveforms. Since the waveform is twice as long, the waveform calculation may be more than twice as long, and twice as much memory may be required to store the digitized waveform.

Figure 6A:
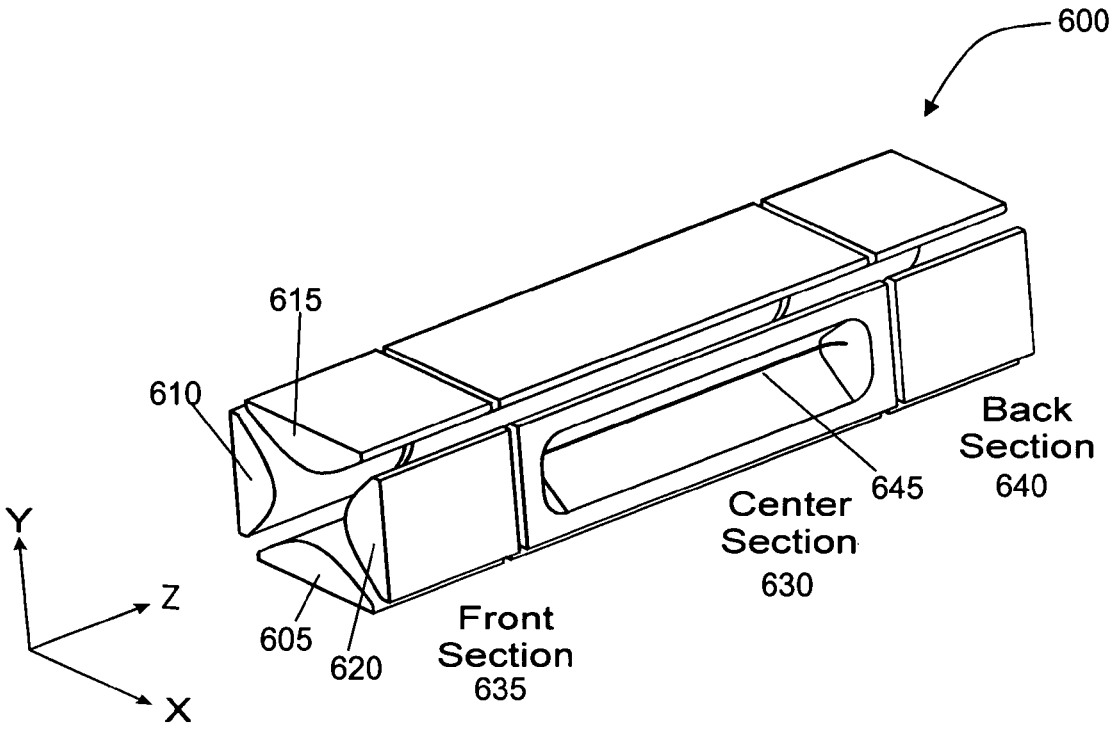
FIGS. 6*a* and 6*b* are schematic diagrams illustrating a 2D linear quadrupole ion trap and a circuit for applying RF and AC voltages to the electrodes of the 2D linear quadrupole ion trap.
Figure 6B:
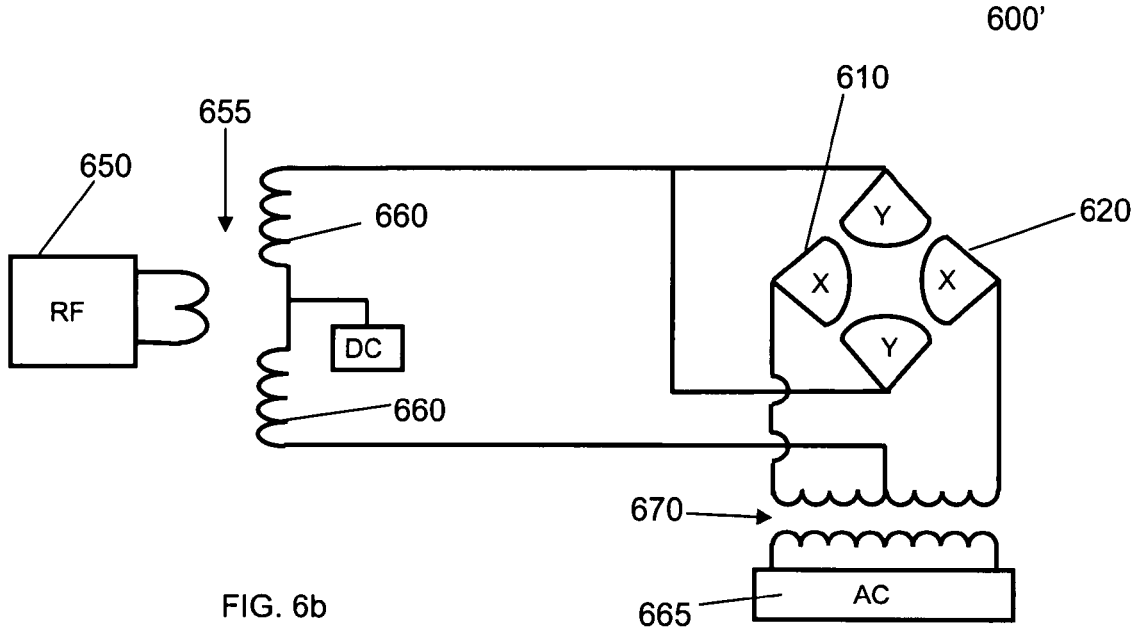
Figure 7:
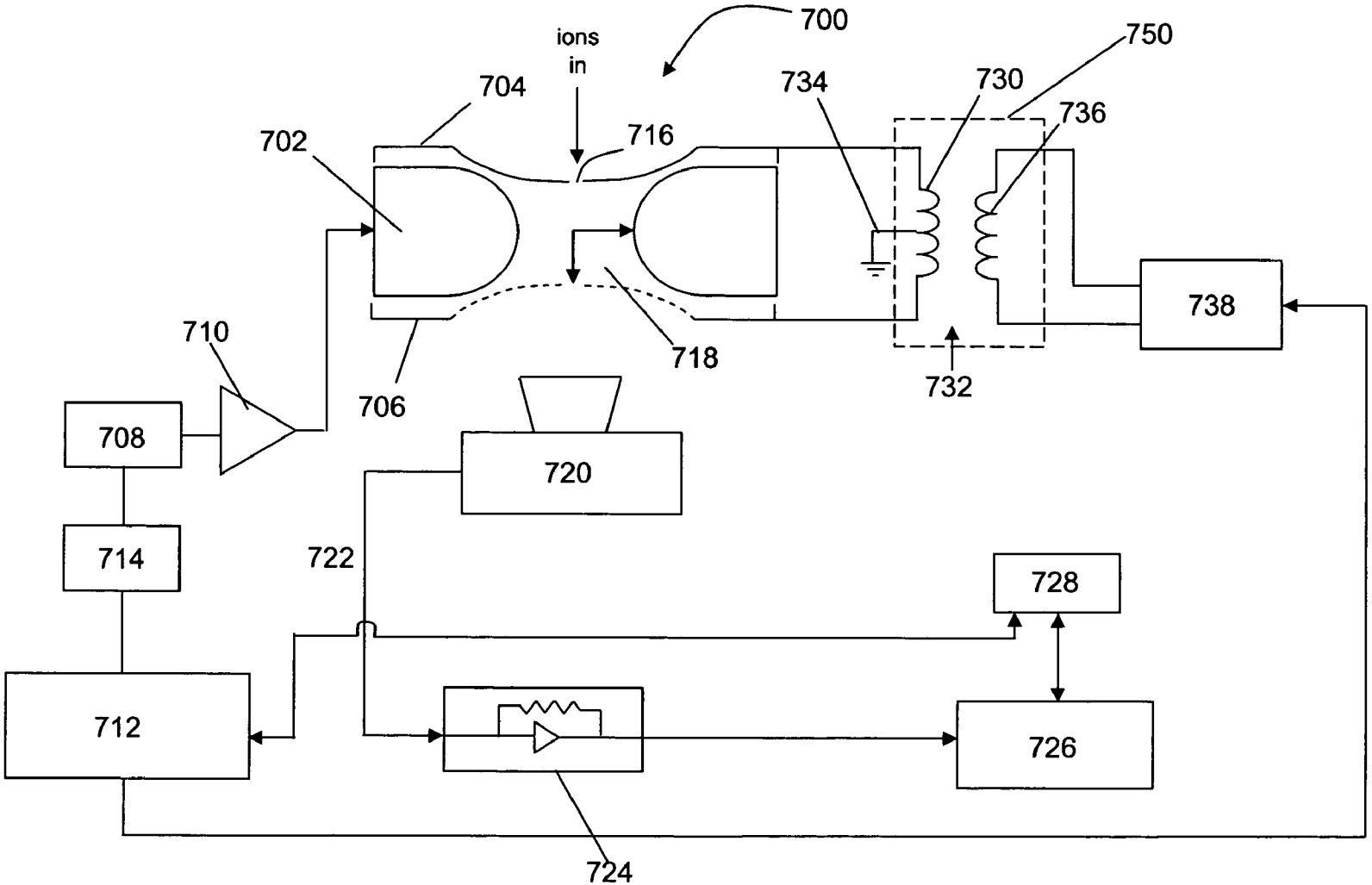
FIG. 7 is a schematic diagram illustrating a 3D quadrupole ion trap and a circuit for applying RF and AC voltages to the electrodes of the 3D quadrupole ion trap.

FIGS. 6*a*-7 illustrate exemplary apparatus which may be used for isolating ions. In alternative implementations, different apparatus can be used to implement one or more aspects of the invention.

FIG. 6*a* illustrates an exemplary quadrupole electrode structure of a linear or two dimensional (2D) quadrupole ion trap 600. The quadrupole structure includes two sets of opposing electrodes including rods that define an elongated internal volume having a central axis along a z direction of a coordinate system. An X set of opposing electrodes includes rods 610 and 620 arranged along the x axis of the coordinate system, and a Y set of opposing electrodes includes rods 605 and 615 arranged along the y axis of the coordinate system. Each of the rods 605, 610, 615, 620 is cut into a main or center section 630 and front and back sections 635, 640.

In one implementation, each rod (or electrode element) has a hyperbolic profile to substantially match the iso-potentials of a two dimensional quadrupole field. A Radio Frequency (RF) voltage is applied (via an RF generator) to the rods with one phase applied to the X set, while the opposite phase is applied to the Y set. This establishes a RF quadrupole containment field in the x and y directions and will cause ions to be trapped in these directions. Other shapes of electrode elements may also be used to create trapping fields that are adequate for many purposes.

To constrain ions axially (in the z direction), the electrodes in the center section 630 can receive a DC potential that is different from that in the front and back sections 635, 640. Thus a DC "potential well" is formed in the z direction in addition to the radial containment of the quadrupole field resulting in containment of ions in all three dimensions.

Ions are introduced into the trap along the center line of the z axis and therefore are efficiently transmitted into the center section. The electrode structure can be operated in high vacuum or some Helium can be introduced into the structure to cause excited ions to lose kinetic energy due to collisions with the Helium. Thus the ions can be more efficiently trapped within the center section of the structure. These collisions also improve performance because the collisionally cooled ions all obtain similar (and small) positions and velocities. This basically gives the ions a smaller set of initial conditions when they are subsequently manipulated, for example during ion ejection.

An aperture 645 is defined in at least one of the center sections 630 of one of the rods 605, 610, 615, 620. Through the aperture 645, trapped ions can be selectively ejected based on their mass-to-charge ratios in a direction orthogonal to the central axis when an additional AC dipolar electric field is applied in this direction. In this example, the apertures and the applied dipole electric field are on the X rod set.

FIG. 6*b* illustrates a conventional apparatus for applying the RF and AC voltages to a 2D ion trap 600'. In the ion trap 600', the rod electrodes 605, 610, 615, 620 are not divided into segments, therefore simplifying the apparatus description. However, the basic scheme for applying the RF and AC voltages to the electrodes 605, 610, 615, 620 does not change if the rod electrodes are segmented. Other methods of applying the RF and AC voltages may be suitable and used if desired, for example, as described in U.S. Patent publication 2003-0173524A1

FIG. 7 illustrates a second exemplary ion trap mass spectrometer, a 3-dimensional quadrupole ion trap 700 which includes a ring electrode 702 of approximately hyperbolic profile and two end caps 704 and 706 facing one another also of hyperbolic profile. RF voltage provided by RF generator 708 is typically applied to the ring electrode 702, and the end caps 704 and 706 are at ground potential with respect to the RF voltage. This establishes a RF quadrupole containment field in all three dimensions, x, y, and z, although since this is a radially symmetric device, often ion motion is discussed in terms of the radial(r) and axial (z) displacements. Note that the ring electrode could be cut into four sections, and thus independent excitation in the x and y dimensions could be created in such a device. Across the end caps 704 and 706 an additional dipolar excitation AC field can be applied via AC generator 738 through transformer 750. A digital signal processor or computer 712 drives a RF voltage control generator 714 which forms a RF control voltage for the RF generator 708, and ultimately the RF amplifier 710 which applies a RF voltage (which may be ramped) on the ring electrode. This in combination with the AC approximately dipolar field applied between the end caps 704, 706 causes ions to be mass selectively ejected from the center of the trap.

In both of the ion traps 600 and 700, various aspects of the invention can be implemented with the difference that the relevant fields are applied in different dimensions.

It has been discussed in detail above that a multifrequency resonance ejection waveform can be used to isolate ions of a particular m/z or range of m/z's. This multifrequency resonance waveform contains frequency components which match or nearly match the characteristic frequencies of motion corresponding to the m/z of the ions which are to be ejected from the trap. These ejection frequency waveforms may be generated by summing many sine wave components throughout a range of discrete frequencies having a specified spacing. Frequency components that match the characteristic frequency of ions to be retained in the trap are left out of the representative waveform. The left-out components define a discrete ejection frequency waveform notch in the frequency spectrum of the ejection waveform. According to one aspect of the invention, the discrete frequency notch is used to specify an m/z isolation window whose width and midpoint can be continuously varied, as discussed in more detail below with reference to FIGS. 8 to 10.

Figure 8:
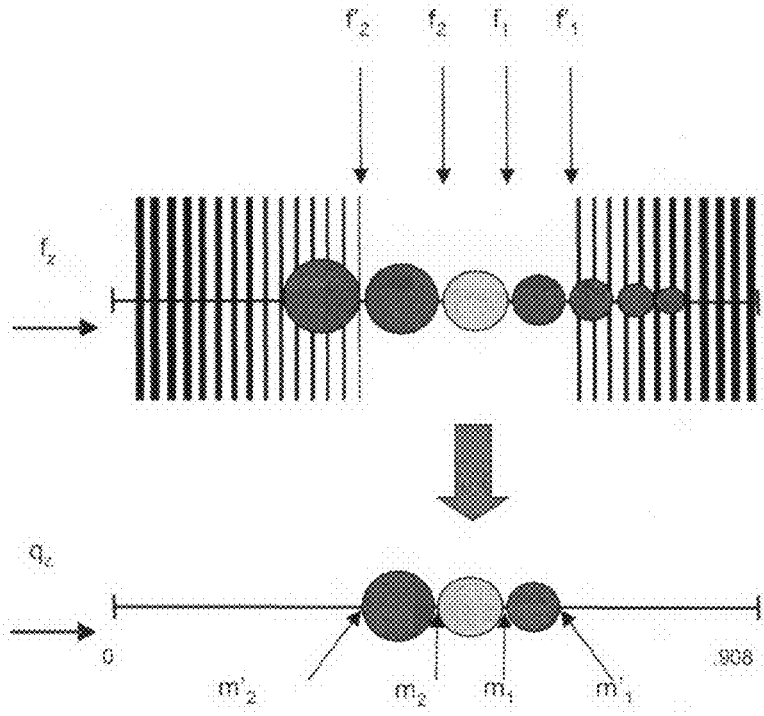
FIG. 8 is a schematic diagram illustrating how isolation of an m/z range is attained according to a method of the prior art.

FIG. 8 illustrates an exemplary ejection frequency waveform calculated by conventional methods such as described in U.S. Pat. No. 5,324,939, incorporated herein in its entirety by reference. The exemplary ejection waveform uses discrete frequency components having a 500 Hz spacing between frequencies of adjacent components. A target ejection waveform frequency notch is defined by the m/z range for which isolation is required and the q at which isolation will be performed. The lower limit of the m/z range is identified by $m_1$ and the upper limit of the m/z range is identified by $m_2$. Based on the values of $m_1$ and $m_2$, corresponding target edge frequencies $f_1$ and $f_2$ can be calculated for the target frequency notch. It should be noted that higher m/z ions have lower frequencies, so $f_1>f_2$ for $m_1m_2$. The target notch edge frequencies $f_1$ and $f_2$ are then rounded outward to the nearest 500 Hz frequencies $f'_1$ and $f'_2$, respectively. The rounded notch edge frequencies $f'_1$ and $f'_2$ correspond to a rounded m/z isolation range between $m'_2$ and $m'_1$.

The rounded notch edge frequencies $f'_1$ and $f'_2$ are contained in the ejection waveform but frequencies between them are absent. In the conventional techniques, the result of the rounding is that a small range of ions outside the desired m/z range will not be ejected because $f'_1>f_1$ and $f'_2<f_2$. In addition, ions with m/z values slightly lower than $m_2'$ and slightly higher than $m_1'$ will be ejected as they are still close enough to the waveform frequency notch edges to be affected by the fields.

According to one aspect of the invention, this "rounding error" can be avoided, and a continuously variable isolation window can be specified. In one implementation, two different quadrupolar field values are used during the isolation process. As used herein, quadrupolar field values are considered to be different if either or both of the RF and DC component values have been changed, and thus the quadrupolar field value may be altered by adjusting one or both of the applied RF and DC voltages. The second quadrupolar field value places the high mass to charge ratio limit of $m_2$ at the rounded notch edge frequency $f'_2$ and the third quadrupolar field value places the low mass to charge ratio limit of $m_1$ at the rounded notch edge frequency $f'_1$. Because the quadrupole field DC and RF amplitudes can be controlled with high precision, the specified m/z isolation window limits $m_1$ and $m_2$ can be placed with high precision at the rounded notch edge frequencies, $f'_1$ and $f'_2$ successively to compensate for the frequency differences between rounded and target notch edges. This technique also allows one to specify continuous effective isolation window widths in m/z.

Figure 9:
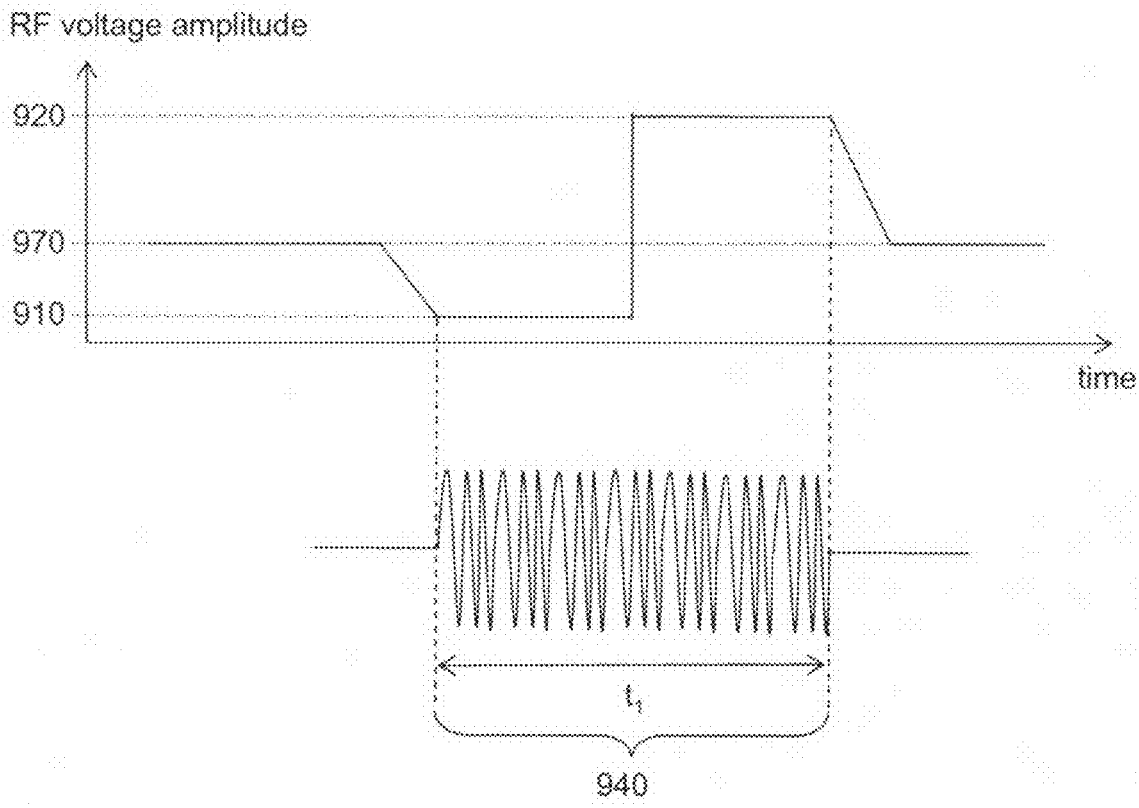
FIG. 9 is a schematic diagram illustrating how isolation of an m/z range is attained according to an aspect of the invention, using a stepped approach.
Figure 10A:
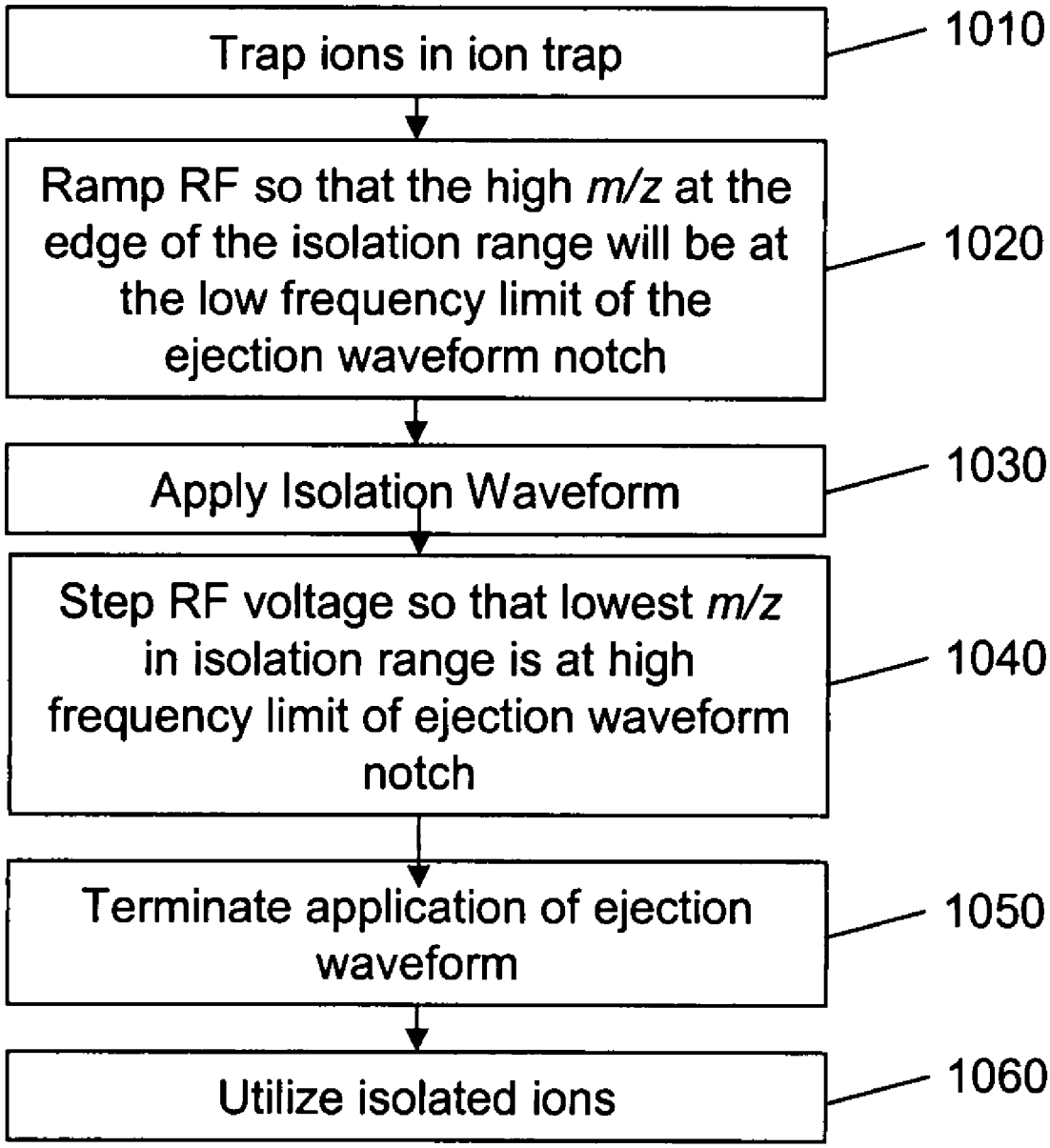
FIG. 10*a* is a schematic flow chart and FIG. 10*b* is a schematic diagram illustrating a method for operating a quadrupole ion trap according to an aspect of the invention.
Figure 10B:
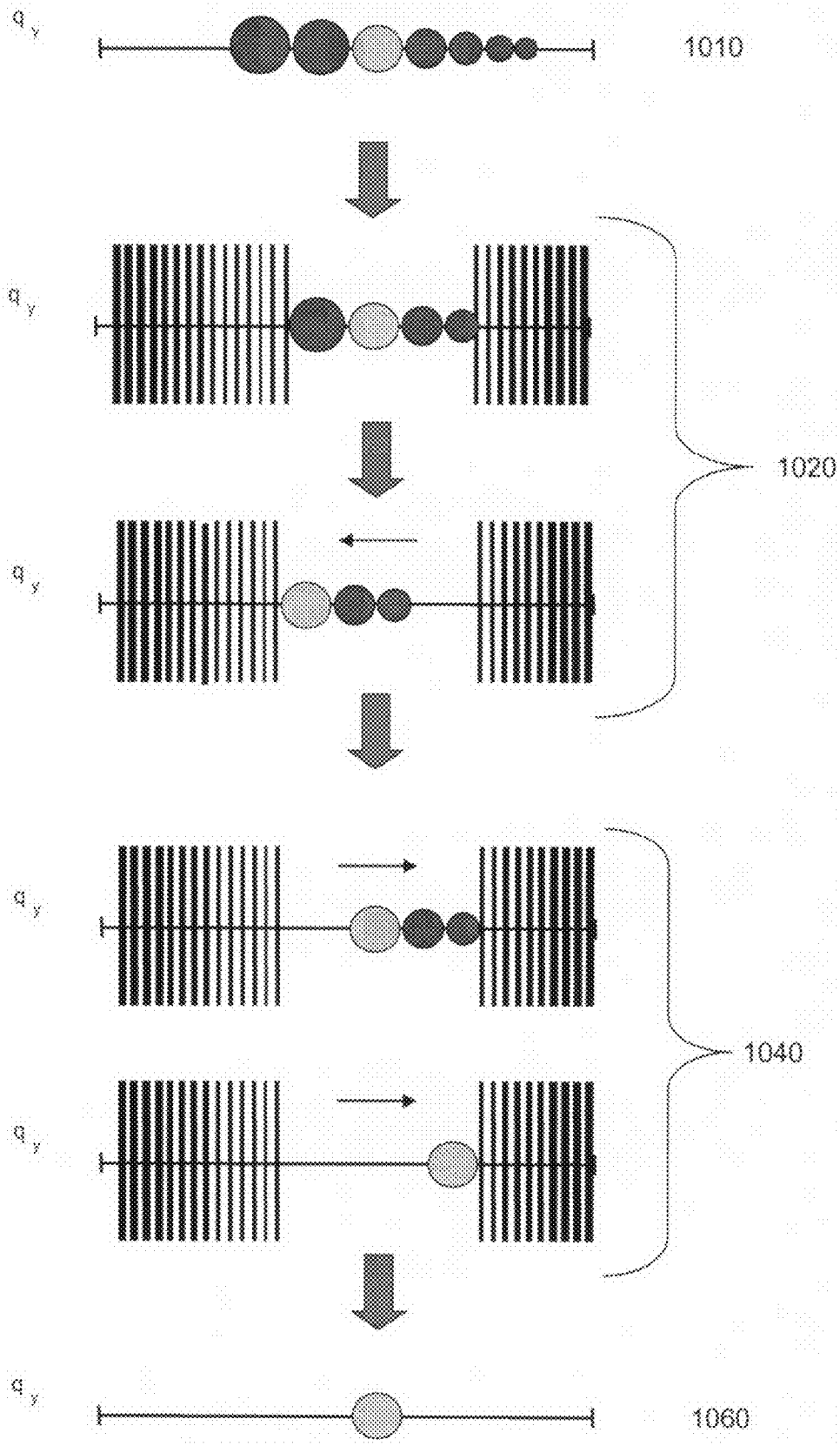

FIGS. 9, 10*a* and 10*b* illustrate an implementation of this technique. The technique can be implemented in a system that includes a quadrupole ion trap, such as a 2D or 3D ion trap. In this implementation, two distinct RF voltage values 910, 920 are used during isolation. Before isolation, the RF voltage value is adjusted to a first value 970 that is used to trap a wide range of ions in an ion trap (step 1010). Next, the RF or DC voltage is adjusted to the second voltage value 910 (step 1020), and an ejection frequency waveform 940 is applied (step 1030). At the second value 910 of the RF voltage, the high m/z limit of the target ion range $m_2$ corresponds to the low frequency edge $f'_2$ (the first edge) of the rounded ejection frequency waveform notch. After a time period, for example 2-8 ms or more, the RF voltage is adjusted in a stepped manner, for example within less than about 1 ms, to the third value 920 (step 1040). At the third value 920 of the RF voltage, the low m/z limit of the desired ion range $m_1$ corresponds to the high frequency edge $f'_1$ (the second edge) of the rounded ejection frequency waveform notch. After a time period, such as after 2 ms or more, for example 2-8 ms, the ejection frequency waveform 940 is turned off (step 1050). The RF voltage can also be adjusted to return to the starting or the first value 970, or set to a value appropriate for a following step. The isolated ions can then be utilized as desired (step 1060). The RF voltage can undergo just a single step while the ejection frequency waveform is turned on.

In this implementation, the system adjusts the RF voltage, which is significantly more precise than the waveform frequency components used in the ejection frequency waveforms. Thus the m/z's at the edges of the resultant isolation window can be set with high precision and a continuously variable isolation m/z resolution or m/z isolation window can be obtained. Furthermore, the frequency spacing in the ejection frequency waveforms is still uniform, which avoids problems associated with adding non-uniform edge frequency components, controlling their amplitude, or using "edge scaling factors".

The high m/z limit and low m/z limit can be set in response to input by the operator of the spectrometer. In one example, the spectrometer receives a selection from the operator of an ion of interest, and uses predefined m/z limits associated with the selected ion. Alternatively, the operator can input the m/z limits directly.

Instead of using simultaneously all frequency components both below $f'_2$ and above $f'_1$, the ejection frequency waveform can be separated into two portions, and the different portions can be applied synchronously with applying the different RF voltage values. A portion of a waveform is a waveform that facilitates some or substantially all ions outside the mass range to be isolated to be ejected from the ion trap. For example, frequency components less than $f'_2$ can be applied while the RF voltage has the second value 910, and frequency components greater than $f'_1$ can be applied while the RF voltage has the third value 920. This is somewhat less desirable, because fragment ions of any of the resonated (ejected) ions can form during the resonance ejection process. Such fragment ions can fall at m/z values for which the currently applied portion of the ejection waveform does not have corresponding ejection frequency components. These fragment ions can survive the isolation process and therefore resulting in incomplete isolation of the ions of interest. They may appear in a product ion m/z spectrum as "artifact" peaks. It is therefore more efficient if all the frequency components of the waveform are simultaneously applied during the entire duration of the isolation method. Alternatively, such "artifact" (fragment) ions can be eventually eliminated by multiple successive cycles of ejection of high m/z and low m/z ions.

Such "artifact" peaks in the mass spectrum can also be avoided by applying two portions of the ejection waveform in separate dimensions in the trap. Thus, instead of applying high and low frequency components of the ejection waveform to electrodes arranged along a single direction, the high frequency components can be applied to a first set of electrodes arranged to create a field polarized in a first dimension, and the low frequency components can be applied to a second set of electrodes arranged to create a field polarized in a second (generally orthogonal) dimension that is different from the first dimension. For example in the 2D linear trap described above, a first set of ejection waveform frequencies can be applied across the two rods in the x dimension, and a second set of ejection waveform frequencies can be applied across the two rods in the y direction. If the 2D trap is used for ion isolation, no slot is required in the rods, because the ejected ions are not detected. If the high frequency and low frequency components are applied simultaneously but orientated along different directions, the fragmentation issue can be avoided. Alternatively, the high and low frequency components can be applied sequentially along different directions, and the fragmentation "artifact" ion issue can be avoided by repeatedly applying both the high and low frequency components.

A series of experiments were performed to measure the effective width of the ejection frequency waveform notch using the techniques described above with reference to FIGS. 8, 9, and 10*a*.

Figure 11:
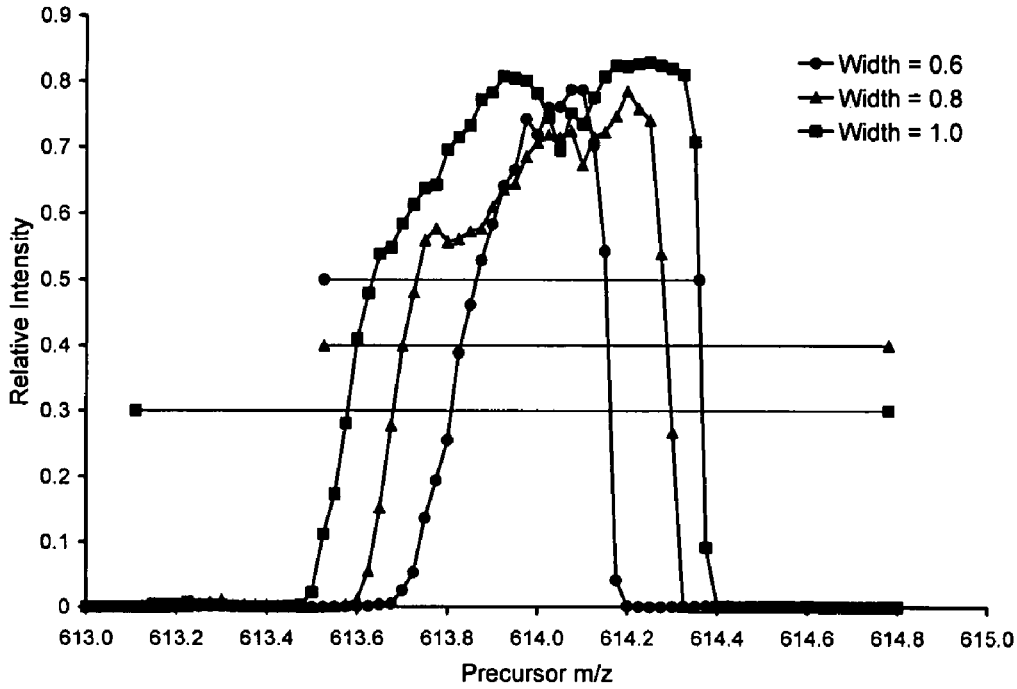
FIGS. 11, 12, 15-17 illustrate experimental results of isolating ions based on aspects of the invention.

FIG. 11 shows experimental results defining experimental widths of isolation windows associated with isolating a m/z 614.0 Th ion from the compound perfluorotributylamine. The experimental widths were obtained for different target widths of the isolation window. To visualize the experimental isolation windows, a series of precursor m/z's were selected, including m/z 614 Th. Each precursor m/z was isolated with the corresponding isolation width, and the intensity of the ion at 614 Th was measured and plotted. During the isolation, the value of the RF voltage was adjusted to successively place the mass $m_1$ and the mass $m_2$ at the respective edges of the rounded ejection frequency waveform notch. Without adjusting the RF voltage, the rounded isolation window had a width indicated by the horizontal lines. Essentially, one can consider the target widths of the isolation window 0.6, 0.8 and 1.0 to be achieved by use of frequency ejection waveforms with, for example, 1, 2 and 3 discrete frequency elements missing respectively.

Figure 12:
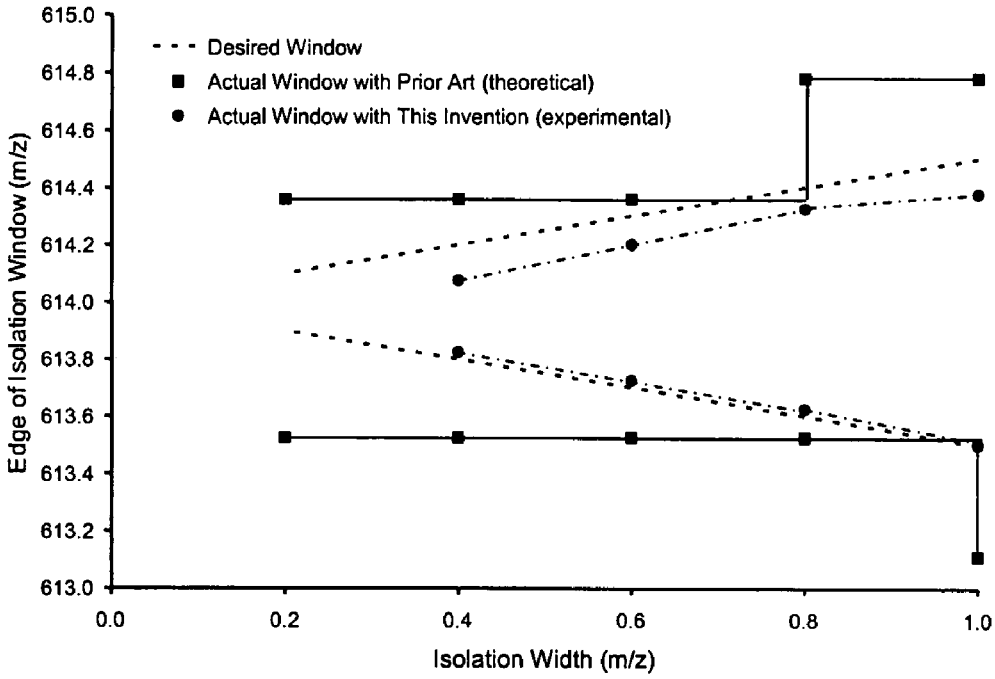

FIG. 12 illustrates a comparison of widths of the isolation window for a traditional isolation method and an isolation technique implemented according to one aspect of the invention. The traditional isolation method, as described earlier, includes using ejection frequency waveforms generated from frequency components rounded out to the nearest 500 Hz, and defines discrete isolation widths which do not match the target isolation window. In contrast, the technique implementing an aspect of the invention does produce an experimental isolation window whose width substantially matches that of the target isolation window.

The data shown in FIGS. 11 and 12 illustrate that, by implementing the invention, the width of the isolation window can be continuously varied even though the ejection frequency waveform notch is quantized. Furthermore, the width of the net m/z isolation window can be finer than the resolution defined by the "discrete" frequency spacing of the ejection frequency waveform. The edges of the isolation profile window can also be more precisely controlled.

In alternative implementations, the techniques discussed above with reference to FIGS. 9, and 10*a* can include different or additional features. For example, the system can use a larger waveform notch, different starting RF voltages, add a reverse scanning step, or replace the quick jump of the RF amplitude with a slower scanning technique. An exemplary implementation of alternative techniques is illustrated pictorially in FIG. 10*b*, and summarized in FIGS. 13 and 14. These alternative techniques may provide higher resolution isolation or minimize the possibility of producing "artifact" peaks.

Figure 13:
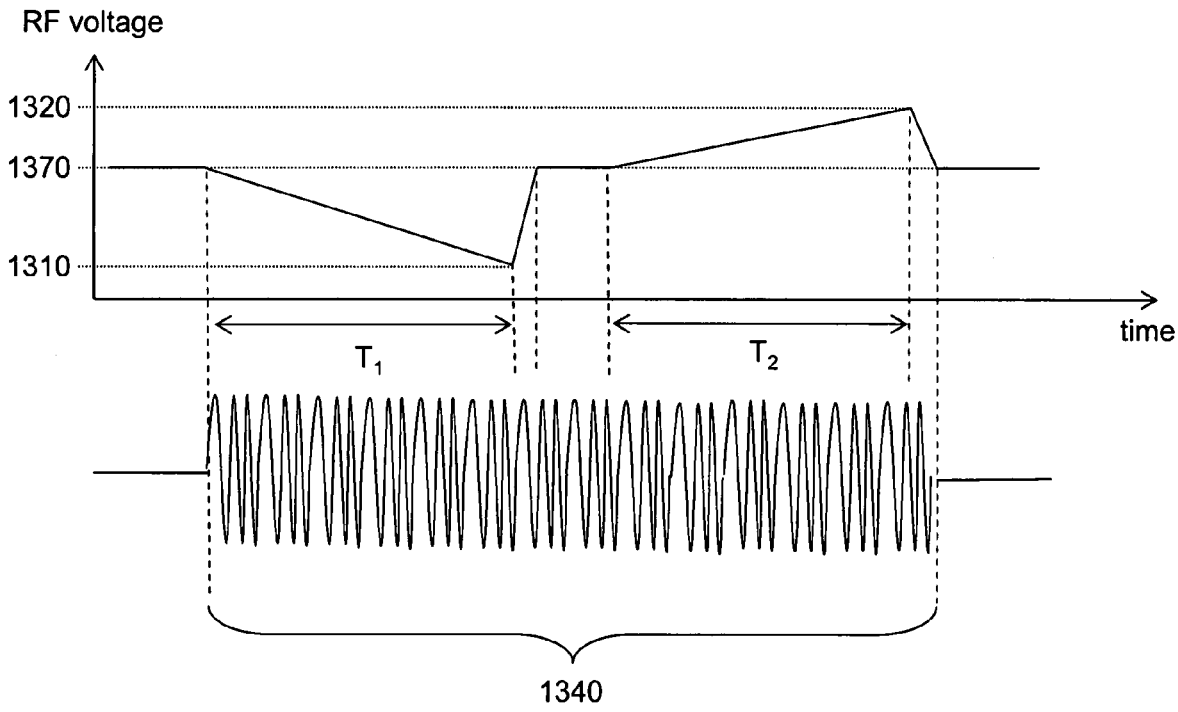
FIG. 13 is a schematic diagram illustrating how isolation of an m/z range is attained according to an aspect of the invention, using a ramped scanning approach that combines an ejection frequency waveform with a slow forward and reverse scan.
Figure 14:
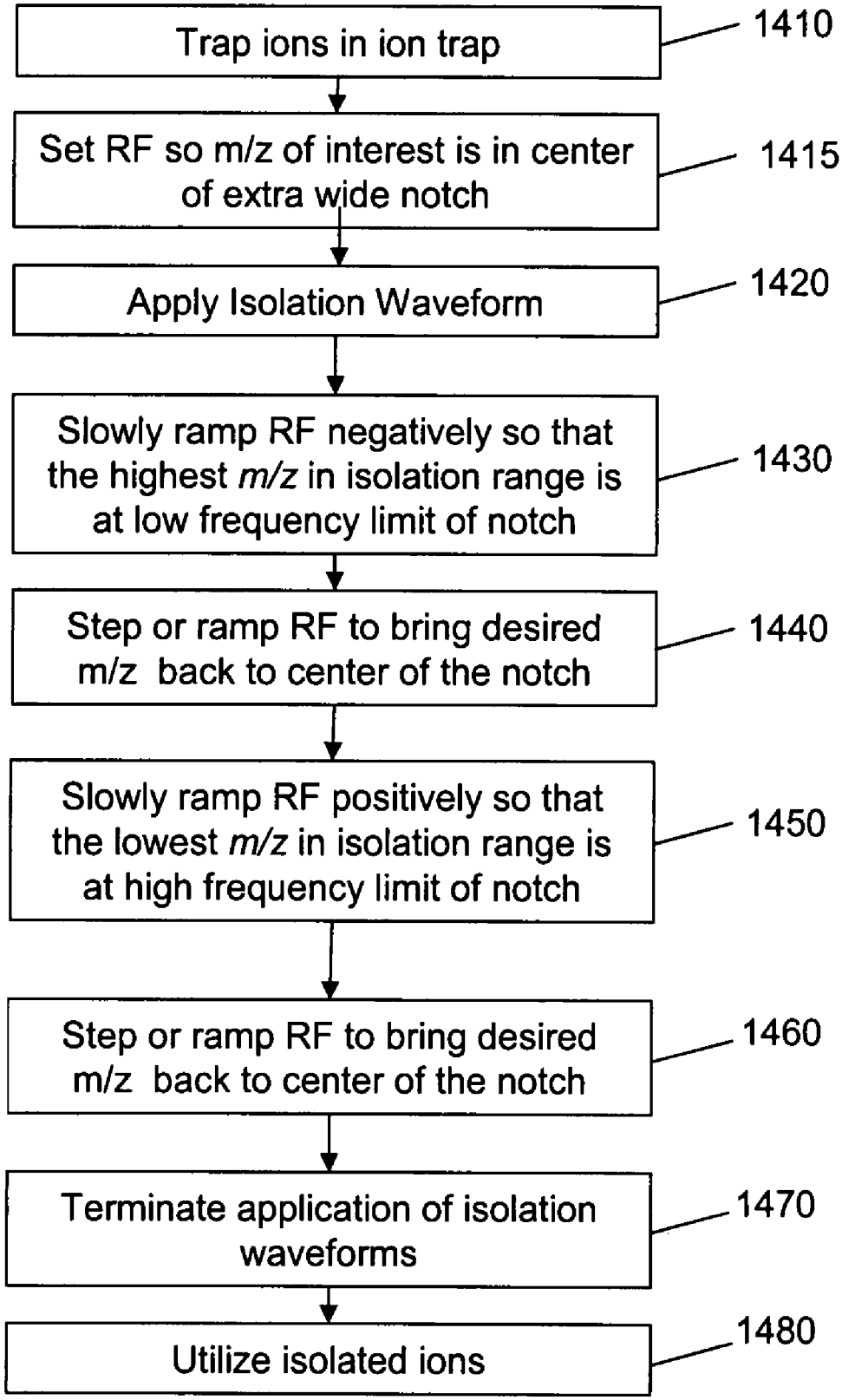
FIG. 14 is a schematic flow chart illustrating a method for operating a quadrupole ion trap according to an aspect of the invention.

FIGS. 13 and 14 illustrate an alternative implementation where an ejection frequency waveform 1340 is constructed with a somewhat larger ejection frequency waveform notch width than in the technique discussed with reference to FIG. 9 for the same target m/z isolation window width. Similar to the method discussed with reference to FIG. 10*a*, an RF voltage is applied with a first value to trap ions in the ion trap (step 1410). With a wider ejection frequency waveform notch width, and before the ejection frequency waveform 1340 is actually applied, the RF voltage 1370 is set such that the m/z range of interest is placed in the center of the target ejection frequency waveform notch (step 1415). This keeps the desired ions to be isolated far from the ejection frequency waveform notch edges and leaves room for a later slow scanning step of the method. The ejection frequency waveform 1340 is then turned on (step 1420), and the RF voltage is ramped slowly to a second value 1310 (step 1430). The RF voltage is ramped for a time $T_1$ that is longer than the time $t_1$ during which the ejection waveform is applied for the stepped RF case (FIG. 9). For example, the time $T_1$ can be larger than 5 ms, such as 10 ms, 15 ms, 20 ms or larger. The second value 1310 of the RF voltage is reached in a reverse direction (negative direction) which brings $m_2$ to the ejection frequency waveform notch edge at $f'_2$. During time $T_1$, higher m/z ions are brought into resonance up to the highest m/z of interest and are ejected from the ion trap. The RF voltage is then stepped or scanned back (step 1440) to the first value 1370. From the first value 1370, the RF voltage is slowly ramped to a third value 1320 (step 1450). The RF voltage is ramped for a time $T_2$ that can be larger than 5 ms, such as 10 ms, 15 ms, 20 ms or larger. The third value 1320 places $m_1$ at the high frequency ejection frequency waveform notch edge at $f'_1$. During time $T_2$, lower m/z ions (below the lowest m/z of interest) are scanned into resonance and are ejected, or otherwise eliminated from the ion trap. In a stepped or scanned manner, the RF voltage returns to the second RF voltage value 1370 (step 1460) and the application of the ejection frequency waveform 1340 then ceases (step 1470). The ions isolated by this technique are then utilized as required (step 1480). In alternative implementations, the scanning steps of this method can be reversed such that the RF voltage at first is scanned forward, and then it is scanned in the reverse direction yielding similar results.

Figure 15:
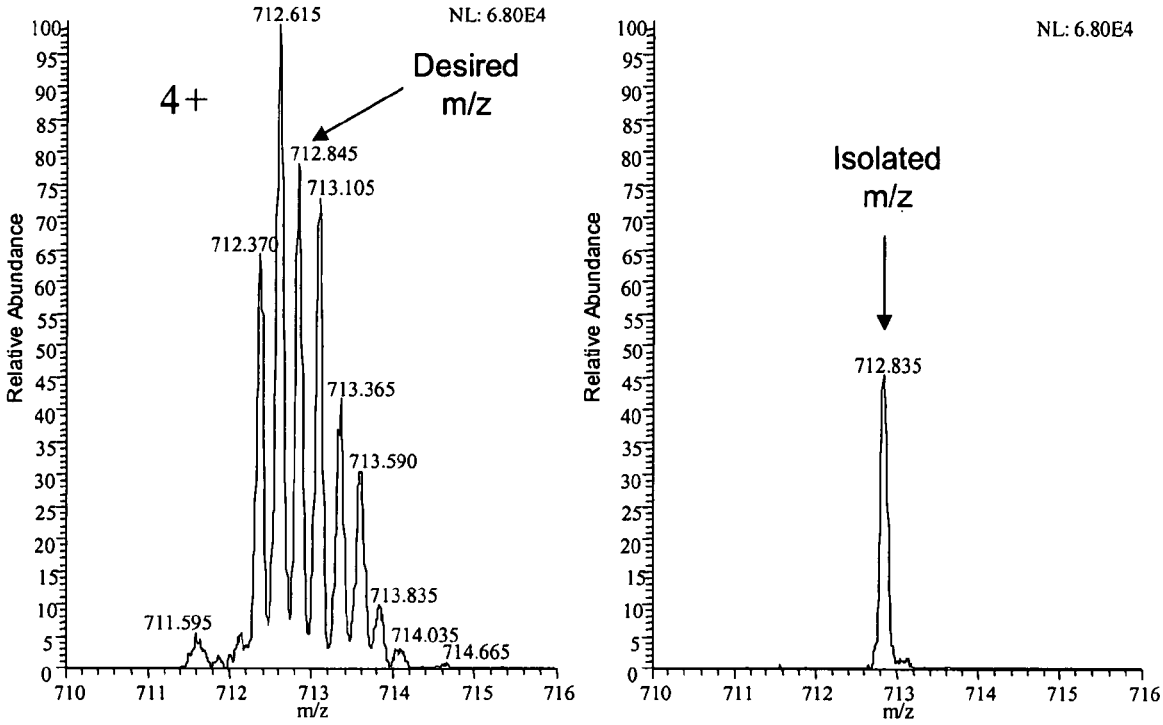
Figure 16A:
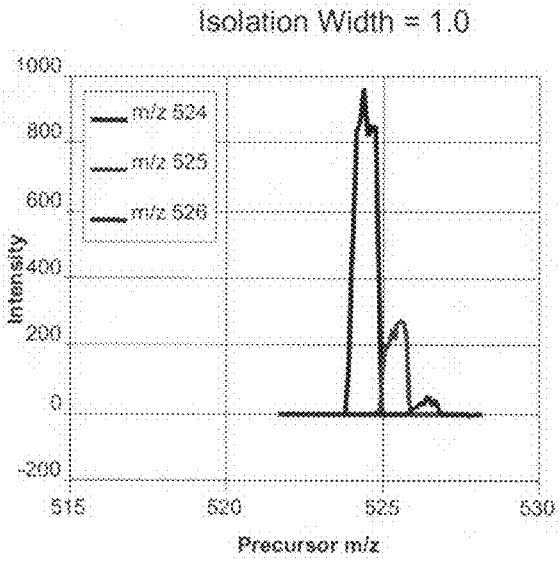
Figure 16B:
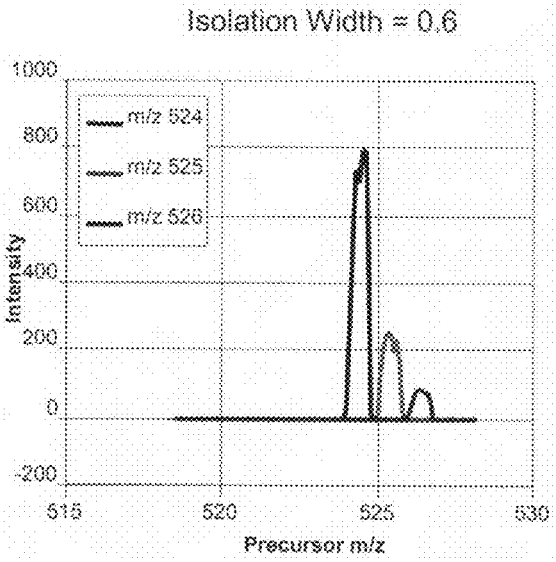
Figure 16C:
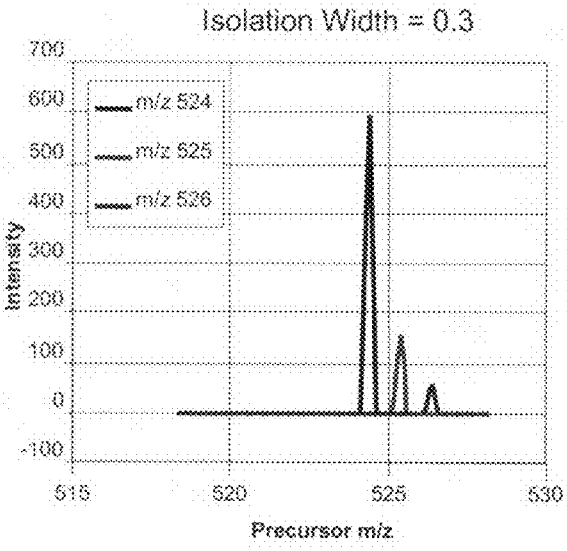
Figure 16D:
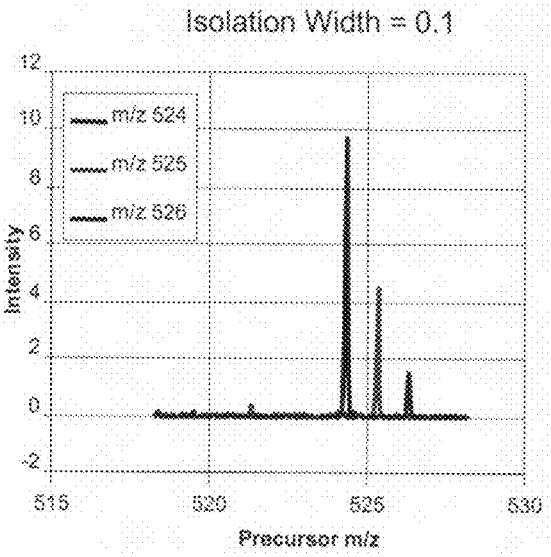
Figure 17:
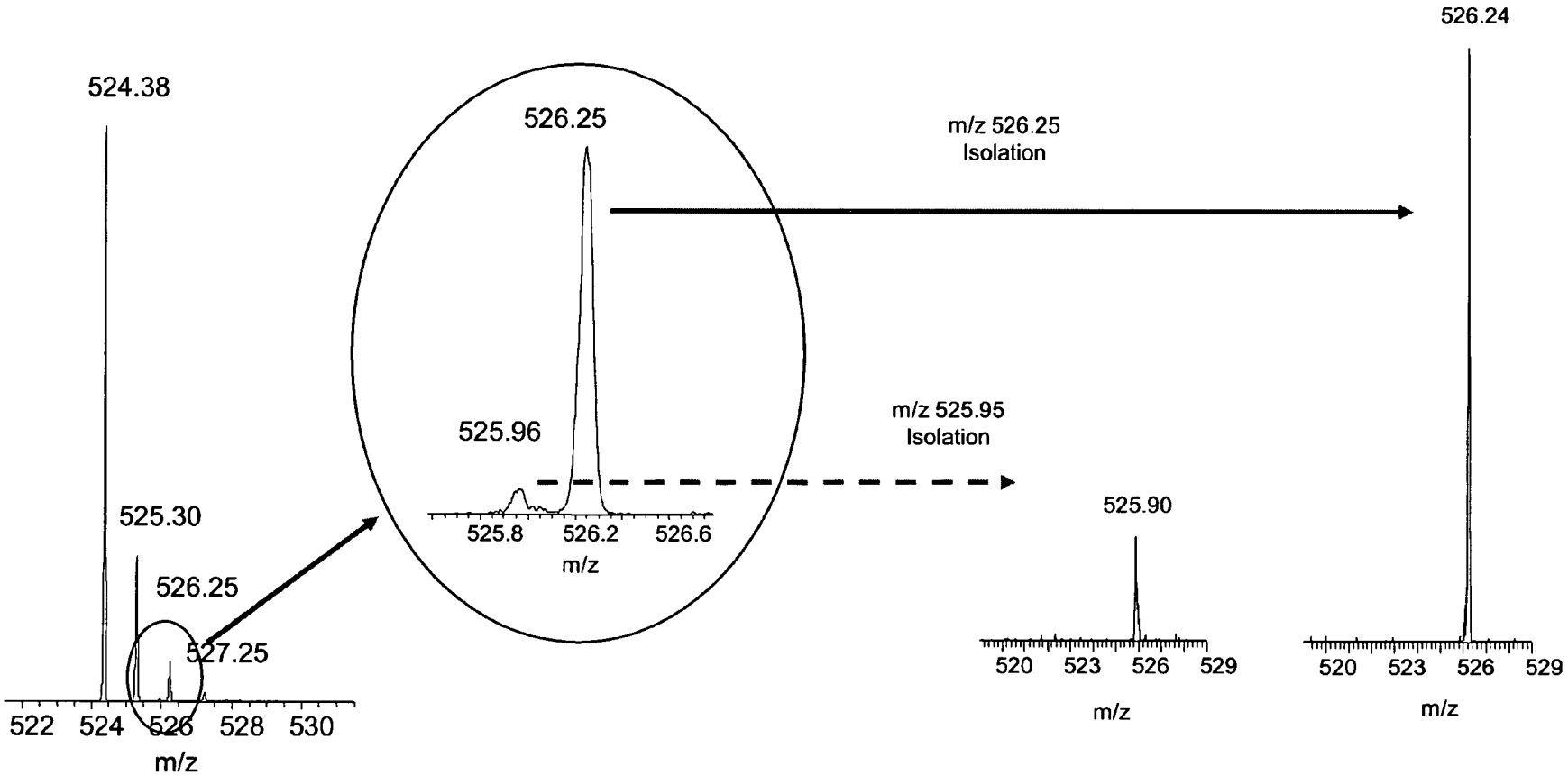

FIGS. 15-17 illustrate that by selecting the appropriate RF voltage values and by reducing the scan rate, high resolution isolation is achieved. FIGS. 16*a* to 16*d* show that the width of the isolation window can be adjusted at relatively high m/z values to below 1 Th. Similar to FIG. 11, the experimental isolation window width is visualized by stepping the precursor m/z across the ejection frequency waveform notch in successive experiments and plotting the intensity of the ion of interest in the post isolation mass spectrum. In this case, m/z 524.3 is an electrospray ion of the peptide MRFA, and its intensity is plotted with that of the second and third isotope peaks at m/z 525.3 and 526.3, respectively. The isotope peaks give perspective to the isolation resolution. The best isolation resolution is shown in FIG. 16*d* where a requested isolation width of 0.1 m/z experimentally shows 0.08 Th. This is the width of the peak shown at half the maximum height. To calculate the isolation resolution, this width is divided into the m/z at which the isolation takes place, m/z 524.3. This is an isolation resolution of greater than 6500.

Using RF scan rates of 24 ms/(Th or amu/unit charge) during the forward and reverse RF scanning isolation steps allows a single $^{13}C$ isotope (FIG. 16*a*) of a quadruply charged ion of the compound Mellitin to be isolated from amongst all the other isotopes (FIG. 16*b*). Further utility is demonstrated in FIG. 17 which shows two ions of interest at the same nominal m/z of 526 Th. These two isobaric ions can only be individually isolated using high resolution isolation techniques such as the one described here. Once isolated, MS/MS can be performed on each ion individually giving structural information free of cross contamination.

As mentioned above, the above techniques can also be implemented by splitting the ejection frequency waveform up into two portions, such as those including high and low frequency components, respectively. The system can apply the two portions at two different times, synchronized with the RF voltage steps, or simultaneously using two separate dipole fields on differently oriented electrodes, for example the X and Y electrodes in a 2D quadrupole ion trap.

In one implementation, the system isolates ions by two independent dipole fields that are applied in two different directions of the ion trap. This technique can improve the boundaries of the m/z isolation window by taking advantage of oscillation amplitude dependent frequency shifts. Although the trapping potential fields are substantially quadrupolar, slots, holes, spacing and shape deviations in the electrode and electrode structures may introduce octopole and other multipole terms of higher order than quadrupole. Due to these higher order terms, as the trapped ions' oscillation amplitude increases, their oscillation frequencies may change.

In one implementation, it is desirable for growth in ion oscillation amplitudes in a first direction (for example along the x axis) to increase the ion oscillation frequencies in that in a first direction, and for growth in ion oscillation amplitudes in a second direction (for example along the y axis) to decrease the oscillation frequencies in a second (for example, y) direction. In this implementation, the ejection frequency waveform is sub-divided into two separate waveforms, and two separate dipole fields are generated with high frequencies above and low frequencies below the ejection frequency waveform notch. During isolation, the high frequency waveform is applied to the x direction and the low frequency waveform is applied to the y direction.

For example, in a 2D linear ion trap, higher than quadrupole terms can be generated by the y rods that are displaced inward from the position at which their contours match the iso-potential contours of a quadrupole field. This would create higher order multipole terms, a mixture of positive quadrupole, octopole, dodecapole and/or higher potentials, to the trapping field such that ion frequencies decrease as the oscillation amplitude increases in the y direction. Or the presence of apertures such as slots in the rods are known to cause higher order multipole field terms. Thus the rods may not have to be displaced at all, and the frequencies would still shift to lower frequencies as the oscillation amplitude increases. Although this may be useful for ion isolation, a negative frequency shift with increasing oscillation amplitude has been shown to give poor mass spectral quality during mass analysis. For this reason, opposing rods which contain slots used for mass analysis are normally spaced outward to some extent or the contours altered. In this case, this stretching helps to compensate for the effects of the rod slots and can make the frequencies shift less negative or more typically even positive with oscillation amplitude. Consequently, if the same ion trap is used for both isolation and mass analysis, its performance can be increased by spacing the y rods inward while the x rods containing the slots are spaced outward or appropriately blunting or sharpening the contours of the rods.

A RF quadrupole ion trap can be designed, utilizing the displacement of any of the rods from the conventional location, combined with the addition of slots and/or apertures appropriately sized and located, or contouring the shape of the electrode surfaces to create desirable field effects.

Figure 5A:
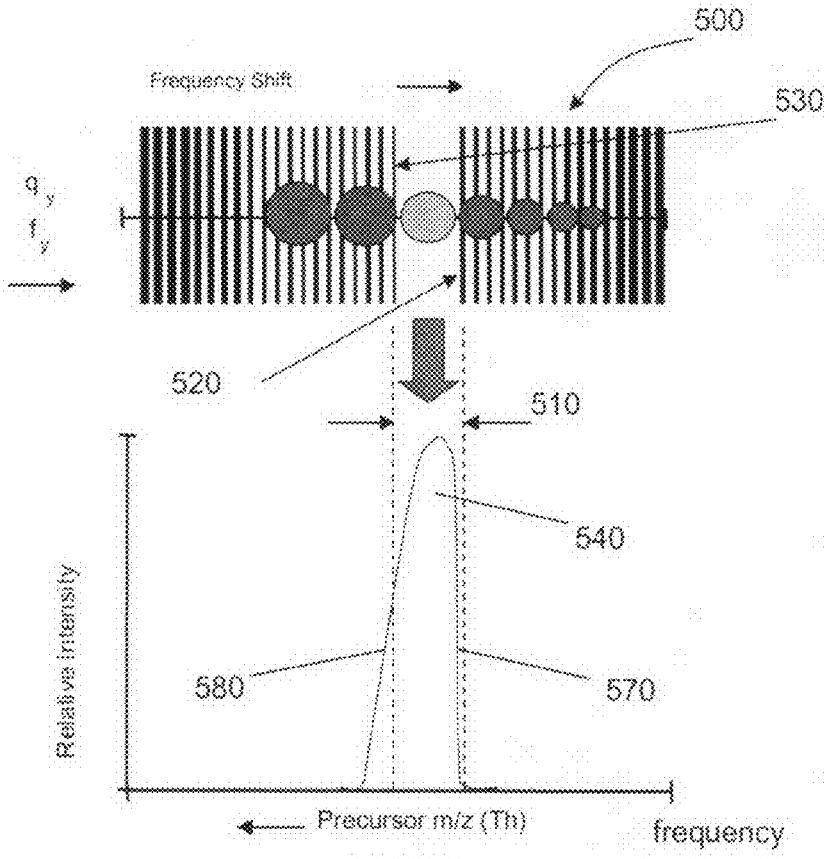
FIGS. 5*a* and 5*b* are schematic diagrams illustrating asymmetric isolation profiles resulting from using prior art isolation techniques.

FIG. 5*a* illustrates schematically an ejection frequency broadband waveform 500 applied for example across the x-rod electrodes of a stretched 2D linear ion trap as described in U.S. Pat. No. 5,420,425. As discussed above, a narrow band of frequencies is omitted from the ejection waveform frequency, and the DC, AC and RF levels are selected such that stability is maintained for the m/z ratio range of interest. This narrow band of frequencies is known as the ejection frequency waveform notch. Trapped ions with characteristic oscillation frequencies which match frequency components of this dipole field resonantly couple to the exciting field. Since the ion trap is of stretched design, ion frequencies will increase as the oscillation amplitude in the x direction increases. Therefore, trapped ions that are within the ejection frequency waveform notch 510 and have characteristic frequencies near the high frequency side 520 (low m/z side) of the frequency notch 510, shift further out of the frequency notch 510 as their oscillation amplitudes increase. This hastens the ejection of the ions because they "run towards", or couple better to the high frequency side of the trailing edge 520 of the ejection frequency waveform notch 510. The result is that, if a plot is made of the ions retained at an instant in time after the supplemental waveform has been applied (and terminated), the low m/z side of the resultant isolation window has a steep incline 570 as shown at the bottom of FIG. 5*a*.

On the other hand, trapped ions having characteristic frequencies near the low frequency side 530 (high m/z side) may begin outside the ejection frequency waveform notch 510 or inside the ejection frequency waveform notch but near the boundary, but as their amplitudes increase, will shift into the frequency notch 510. Due to the shift, their ejection can be delayed or even prevented. Ions essentially "run away" from the leading edge 530 of the ejection frequency waveform notch 510. The result is that if a plot is made of the ions retained at an instant in time after the supplemental waveform has been applied and terminated, the high m/z side of the resultant isolation window has a gradual incline 580 (see FIG. 5*a*) and the resultant isolation window edge appears to be smeared. These frequency shifting effects combine to produce the asymmetric profile 540.

Figure 5B:
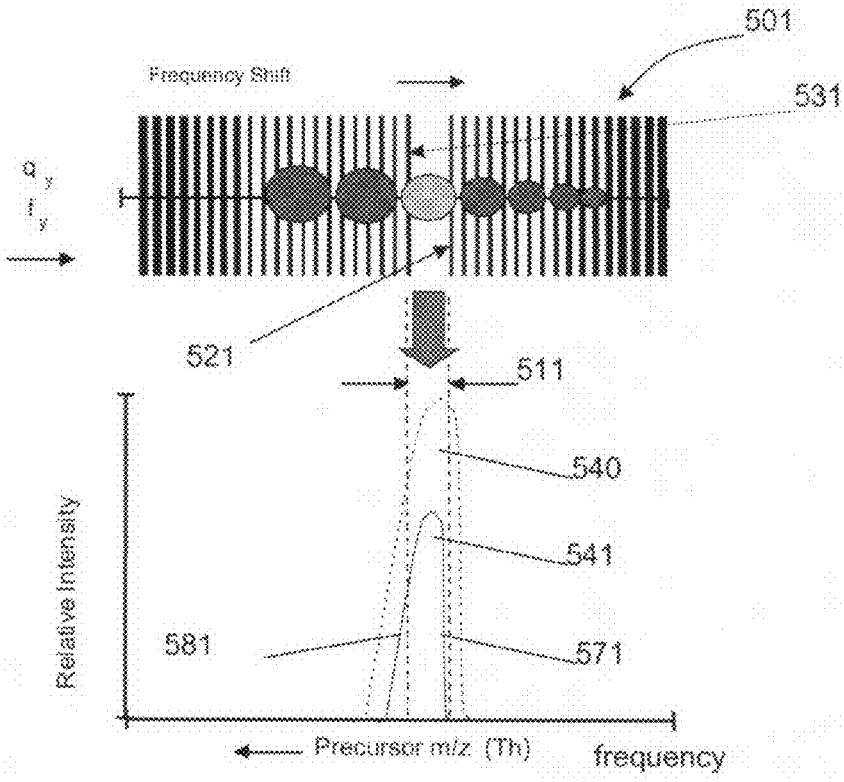

The ejection frequency waveform notch 510 can be made narrower in an attempt to get higher resolution isolation (as indicated by 511) by omitting a narrower range of frequencies from this ejection waveform 501 compared to 500 as shown FIG. 5*b*. However, the asymmetric profile dictates that when the ejection frequency waveform notch is narrowed, the relative intensity (ion retention) (compare 541 to 540) drops rapidly rendering this method of achieving higher resolution ineffectual.

These effects are also affected by the duration the application of the ejection frequency waveform, and other parameters which influence how quickly the ions take up energy from the ejection frequency waveform and are ejected. These parameters include the amplitude of the waveform voltages, the pressure in the ion trap, the isolation q value, and the magnitude sign of the higher order field components.

The higher order field components may include octopole and dodecapole as well as other higher order multipole terms. A positive octopole field (for purposes of this specification) is defined as having a positive pole on the same axis as the positive pole for the quadrupole field. As an example, consider a 2D ion trap where the quadrupole field has a positive pole on the x axis. A positive octopole field co-generated (made with same applied voltage) with and superposed on this quadrupole field would also have a positive pole on the x axis. This superposed positive pole strengthens the field at increased displacements along the x axis. On the y axis the quadrupole field has a negative pole. The positive octopole field has a positive pole on the y axis. This positive pole from the octopole field weakens the total field at increased displacements along, the y axis. A positive dodecapole field has a positive pole on the x axis but a negative pole on the y axis. The positive dodecapole field therefore strengthens the total field at increased displacements along both the x and y axes. Higher order fields than octopole and dodecapole behave in similar ways. The effects on the frequency of motion of ions in these fields is discussed below.

In a RF quadrupole ion trap that creates a field primarily composed of a positive quadrupole (with positive poles on the x axis) and a positive octopole field, the ions' oscillation frequencies in the x dimension will increase as the ions' oscillation amplitude along the x axis increases. This is a result of the positive octopole field strengthening the field at increased displacements along x axis. In the same structure, the ion oscillation frequencies in the y dimension will decrease as ion oscillation amplitudes increase along the y axis. This is the result of the positive octopole field weakening the total field at larger displacements along the y axis.

Similarly, in a RF quadrupole ion trap that creates a field including a positive quadrupole (with positive poles on the x axis) and a negative octopole field, the ion x dimension oscillation frequencies will decrease as oscillation amplitudes along the x axis increase. In the same structure, the ion oscillation frequencies in the y dimension will increase as the ion oscillation amplitudes along the y axis increase.

A RF quadrupole ion trap that is designed to create a quadrupole and a positive dodecapole field, enables one to influence the motion of ions along both the x and y axes such that the corresponding oscillation frequency increases as the ion oscillation amplitude increases along either axis. A RF quadrupole ion trap designed to create a quadrupole and a negative dodecapole field, enables one to influence the motion of ions on both the x and y dimensions such that the corresponding oscillation frequency decreases as the ion oscillation amplitude increases along either axis.

When creating fields with higher order multipole fields, one must be mindful of all the superposed multipole fields. For example, a positive dodecapole field can strengthen the field larger displacements along the y axis enough to overcome the weakening of the positive octopole field. Therefore, ion frequencies in the y dimension may not decrease as the oscillations along the y axis increases as it would with only the positive octopole field.

This discussion gave as an example a 2D ion trap where the x axis had a positive quadrupole field pole. The same behavior occurs even if the quadrupole field is not oriented this way. The octopole field will nonetheless strengthen the field at increased displacements along one axis while weakening at increased displacements in the other. The dodecapole field will strengthen the field at increased displacements along either axis. Higher order fields in 3D ion traps behave in similar ways. One can think about higher order fields strengthening and weakening the field at increased displacements along the r and z axes (cylindrical coordinates), or even on three (the x, y, and z) axes.

FIGS. 18 and 19 illustrate the use of these methods for improving ion isolation. Ions are first trapped in an ion trapping step 1910. The trapped ions that have an m/z ratio greater than the m/z ratio range of the ions of interest 1810 are excited by the low frequency components 1800 of the broadband ejection frequency waveform in order to eject a first range of ions having m/z ratios greater than 1810 (step 1920). These low frequency components of the ejection frequency waveform 1800 are applied as a separate waveform (with respect to the higher frequency components of the ejection frequency waveform) to the x direction electrodes of the ion trap. The x and y electrodes are spaced and profiled such that the resultant potentials of a mixture of quadrupole, octapole, dodecapole and higher order potentials cause ion frequencies shift negatively as their y oscillation amplitudes increase. Therefore, trapped ions with ion frequencies near the low frequency limit (high m/z limit) of the isolation window 1810 shift further out of the isolation window as their oscillation amplitudes increase. This hastens the ejection of the ions as they "run towards" the leading edge 1830 of the isolation window 1810. The result is that in a plot illustrating relative intensities of the ions retained after the ejection frequency waveform has been applied, the high m/z limit of the resultant isolation window has a steep incline 1880 as shown at the bottom of FIG. 18*a* resulting in a sharp resultant isolation window edge.

Similarly, trapped ions having an m/z ratio less than the m/z ratio range of the ions of interest 1810 are excited by the high frequency components 1805 of the broadband ejection frequency waveform in order to eject a second range of ions having m/z ratios less than 1820 (step 1930). These high frequency components of the ejection frequency waveform 1805 are applied as a separate waveform (with respect to the lower frequency components of the ejection frequency waveform) to the y direction electrodes of the ion trap. The x and y electrodes have been spaced and profiled such that the resultant potentials of a mixture of quadrupole, octapole, dodecapole and higher order potentials cause ion frequencies shift positively as their amplitude of x oscillation increases. Therefore trapped ions with ion frequencies near the high frequency limit (low m/z limit) of the isolation window 1810 also shift further out of the isolation window 1810 as their oscillation amplitude increases. This also hastens the ejection of the ions as they "run towards" edge 1820 of the isolation window 1810. The result is that in a plot illustrating relative intensities of the ions retained after the ejection frequency waveform has been applied, the low m/z limit of the resultant isolation window also has a steep incline 1870 as shown at the bottom of FIG. 18*a*. Using this method, any trapped ions, which may start just outside the resultant isolation window, can not shift to frequencies which may be inside the resultant isolation window (as in prior art FIG. 5) eliminating the asymmetric profile 540 of the prior art as described. With such an optimized resultant isolation window profile, the width of the resultant isolation window 1810 can be reduced as is shown in FIG. 18*b* without reducing the efficiency of retaining the ions of interest. This is unlike that is shown in 541 of the prior art which indicates a loss of the ions of interest due to the notch edge being significantly less sharp.

In one implementation of this method, the two waveforms are applied simultaneously to the x and y electrode pairs to avoid storing any fragment ions which may be generated by one or the other isolation waveforms. Alternatively, the two waveforms can be applied sequentially. The effectiveness of this method depends on several variables including the application time of the waveforms, the amplitude of the waveform voltage, the behavior of the non-linear higher order field components in each direction, and the width in frequency of the isolation window. The higher order fields can be achieved in many ways including simple spacing of the electrodes of hyperbolic shape, changing the profile of the electrodes from the theoretical hyperbolic shape, and adding additional electrodes to influence the resultant fields. One may consider and be cognizant of the effects of all of the higher order fields introduced. For example, in a 2-D trap, positive quadrupole, combined with a positive dodecapole field would cause ion frequencies to increase in both x and y with increased oscillation amplitude. Therefore, the sum effect of the octopole and dodecapole terms (as well as other higher order multipole field terms) should be considered. It will be the combined effect of all the multipole field terms that govern the behavior of ions.

These discussions of applying two waveforms in different dimensions described ejecting low m/z ions in one dimension and high m/z ions in the other. Alternatively, the two waveforms could both eject low and high m/z ions. If the two waveforms were applied simultaneously, all undesired ions could gain kinetic energy and be ejected in either dimension. This could lead to undesired coupling effects of the ion motion in the two dimensions. It might be better to apply the waveforms sequentially. To take advantage of the improved isolation resolution afforded by the amplitude dependent ion frequency shifts, it might be best to make the notch wider on the side that does not give a steep incline in the isolation window. The first waveform would be set to give a steep incline on, for example, the low m/z side, while the second gives a steep incline on high m/z side. Additional frequency components would be left out at the high m/z side of the first waveform to prevent it from causing a gradual incline of the isolation window on the high m/z side. The second waveform would create the steep incline on the high m/z side. Likewise, additional frequency components would be left out at the low m/z side of the second waveform to prevent it from causing a gradual incline of the isolation window on the low m/z side. The advantage of having some frequency components on the low m/z side is fragment ions formed are ejected. This is advantageous as long as these frequencies are not too close to the desired low m/z limit.

Although described in more detail here for 2D linear ion traps, these techniques can be also used for 3D quadrupole ion traps. A conventional three dimensional (3D) quadrupole ion trap is described in U.S. Pat. No. 4,540,884 which is incorporated in its entirety. A 3D ion trap with a positive dominant octopole field superposed on the main quadrupole trapping field can be realized by displacing endcap electrodes which contain apertures outward from the position at which their contours match the iso-potential contours of a quadrupole field and shrinking the $r_0$ of the ring electrode without altering the hyperbolic shape. Ion frequencies will increase as the oscillation amplitude increases in the z direction. The high frequency components of the ejection waveform and the low frequency components of the ejection frequency waveform would be excited in the z and r directions respectively. This can be accomplished by segmenting the donut shaped ring electrode into 4 segments. This then breaks the r dimension into x and y directions explicitly and allows approximate dipolar resonance excitations to be applied in either or both directions independently. As examples, the combination of the low frequency components of the ejection waveform and the high frequency components of the ejection frequency waveform could be applied in all combinations of x, y and z, namely, x and y, x and z, y and z. Of course, it also allows for 3 different waveforms to be applied to create different ejection waveform dipole fields, polarized in each dimension, in all three directions x, y and z for example. Some configurations and combinations may enable one to create two resultant isolation profile windows instead of one.

The methods of the invention can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The foregoing descriptions of specific embodiments of the present invention are presented for the purposes of illustration and description. They are not intended to be exhaustive or to limit the invention to the precise forms disclosed; many obvious modifications and/or variations are possible in view of the above teachings. The embodiments are chosen and described in order to best explain the principles of the invention and its practical applications, to thereby enable others skilled in the art to utilize the invention and various embodiments with various modifications as are suited to the particular use contemplated. It is intended that the scope of the invention be defined by the following claims and their equivalents.

Those skilled in the art may be able to combine the features explained on the basis of the various exemplary embodiments and, possibly, will be able to form further exemplary embodiments of the invention.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method for isolating ions in an ion trap utilizing a DC and/or RF voltage to generate a field having a first amplitude value to contribute to the trapping of ions in the ion trap, the ions to be isolated having a range of mass to charge ratios defined by a first mass to charge ratio limit and a second mass to charge ratio limit, and an initial corresponding range of characteristic frequencies, the characteristic frequencies comprising frequency components of a first dimension and frequency components of a second dimension, the ion trap including electrodes comprising electrodes aligned along the first dimension and electrodes aligned along the second dimension, the method comprising:

ejecting substantially all ions outside the range of mass to charge ratios to be isolated by:

applying a first portion of an ejection frequency waveform across the electrodes aligned to the first dimension, the first portion of the ejection waveform comprising at least a first frequency edge and a second frequency edge in the first dimension, and at least the initial corresponding range of characteristic frequencies in the first dimension of the range of mass to charge ratios to be isolated are included in the range of frequencies between the first edge and the second edge;

applying a second portion of the ejection frequency waveform across the electrodes aligned to the second dimension, the second portion of the ejection frequency waveform having a third frequency edge and a fourth frequency edge in the second dimension, and at least the initial corresponding frequencies in the second dimension of the range of ions to be isolated are included in the range of frequencies between the third edge and the fourth edge;

wherein the first portion of the ejection frequency waveform is composed of a first set of component frequencies and the second portion of the ejection frequency waveform is composed of a second set of component frequencies different from the first set.

2. The method of claim 1, wherein the first portion of the ejection frequency waveform and the second portion of the ejection frequency waveform are applied substantially simultaneously.

3. The method of claim 1, wherein the first portion of the ejection waveform and the second portion of the ejection waveform are applied sequentially.

4. The method of claim 1, further comprising:

adjusting the field from a second amplitude value to a third amplitude value, the second and the third amplitude values selected such that substantially all ions outside the range of mass to charge ratios to be isolated are eliminated from the ion trap.

5. The method of claim 1, wherein the ejection frequency waveform is composed from a sequence of substantially uniformly spaced component frequencies.

6. The method of claim 5, wherein the adjacent frequencies in the sequence are spaced about 750 Hz or less from each other.

7. The method of claim 5, wherein the adjacent frequencies in the sequence are spaced about 500 Hz or less from each other.

8. The method of claim 1, wherein applying one of the two waveform portions causes an increase of oscillation amplitudes of ions and a shift of the first oscillation frequency of the ions in a first direction.

9. The method of claim 8, wherein applying the other of the two waveform portions causes an increase of oscillation amplitudes of the ions and a shift of the second oscillation frequency of the ions in a second direction.

10. The method of claim 9, wherein the first direction is opposed to the second direction.

11. The method of claim 1, wherein the quadrupolar ion trap is a substantially quadrupolar non-linear ion trap.

12. A method for isolating ions in an ion trap utilizing a DC and/or RF voltage to generate a field having a first amplitude value to contribute to the trapping of ions in the ion trap, the ions to be isolated having a range of mass to charge ratios defined by a first mass to charge ratio limit and a second mass to charge ratio limit, and an initial corresponding range of characteristic frequencies, the characteristic frequencies comprising frequency components of a first dimension and frequency components of a second dimension, the ion trap including electrodes comprising electrodes aligned along the first dimension and electrodes aligned along the second dimension, the method comprising:

ejecting substantially all ions outside the range of mass to charge ratios to be isolated by:

applying a first portion of an ejection frequency waveform across the electrodes aligned to the first dimension, the first portion of the ejection waveform comprising at least two frequencies, the first portion of the ejection frequency waveform having at least a first frequency edge;

applying a second portion of the ejection frequency waveform across the electrodes aligned to the second dimension, the second portion of the ejection frequency waveform comprising at least two frequencies, the second portion of the ejection frequency waveform having at least a second frequency edge;

wherein the first portion of the ejection frequency waveform is composed of a first set of component frequencies and the second portion of the ejection frequency waveform is composed of a second set of component frequencies different from the first set.

13. The method of claim 12, wherein the first portion of the ejection frequency waveform and the second portion of the ejection frequency waveform are applied substantially simultaneously.

14. The method of claim 12, wherein the first portion of the ejection frequency waveform and the second portion of the ejection frequency waveform are applied sequentially.

15. The method of claim 12, further comprising:

adjusting the field from a second amplitude value to a third amplitude value, the first and the second amplitude values selected such that substantially all ions outside the range of mass to charge ratios to be isolated are eliminated from the ion trap.

16. The method of claim 12, wherein the ejection frequency waveform is composed from a sequence of substantially uniformly spaced component frequencies.

17. The method of claim 16, wherein the adjacent frequencies in the sequence are spaced about 750 Hz or less from each other.

18. The method of claim 16, wherein the adjacent frequencies in the sequence are spaced about 500 Hz or less from each other.

19. The method of claim 12, wherein applying one of the two waveform portions causes an increase of oscillation amplitudes of ions and a shift of the first oscillation frequency of the ions in a first direction.

20. The method of claim 19, wherein applying the other of the two waveform portions causes an increase of oscillation amplitudes of the ions and a shift of the second oscillation frequency of the ions in a second direction.

21. The method of claim 20, wherein the first direction is opposed to the second direction.

22. The method of claim 12, wherein the ion trap is a substantially quadrupolar non-linear ion trap.

23. The method of claim 1, wherein the component frequencies of the first set are higher than the component frequencies of the second set.

24. The method of claim 12, wherein the component frequencies of the first set are higher than the component frequencies of the second set.

* * * * *